US012385340B2

(12) United States Patent
Gar et al.

(10) Patent No.: US 12,385,340 B2
(45) Date of Patent: Aug. 12, 2025

(54) REDUCED BACKLASH SEALING/ANCHORING ASSEMBLY

(71) Applicant: Halliburton Energy Services, Inc., Houston, TX (US)

(72) Inventors: Shobeir Pirayeh Gar, Carrollton, TX (US); Xiaoguang Allan Zhong, Singapore (SG); Frank Vinicia Acosta Villareal, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/074,862

(22) Filed: Dec. 5, 2022

(65) Prior Publication Data

US 2024/0183236 A1 Jun. 6, 2024

(51) Int. Cl.

| | |
|---|---|
| ***E21B 23/01*** | (2006.01) |
| ***E21B 33/10*** | (2006.01) |
| ***E21B 33/12*** | (2006.01) |
| ***E21B 33/128*** | (2006.01) |

(52) U.S. Cl.

CPC ..... *E21B 23/01* (2013.01); *E21B 33/10* (2013.01); *E21B 33/1216* (2013.01); *E21B 33/128* (2013.01)

(58) Field of Classification Search

CPC ..... E21B 33/128; F16L 55/132

See application file for complete search history.

(56) References Cited

U.S. PATENT DOCUMENTS

| | | | |
|---|---|---|---|
| 1,525,740 | A | 2/1925 | Howard |
| 2,075,912 | A | 4/1937 | Roye |
| 2,590,931 | A | 4/1952 | Cabaniss |
| 2,743,781 | A | 5/1956 | Lane |
| 2,865,454 | A | 12/1958 | Richards |
| 3,206,536 | A | 9/1965 | Goodloe |
| 3,371,716 | A | 3/1968 | Current |
| 3,616,354 | A | 10/1971 | Russell |
| 3,706,125 | A | 12/1972 | Hopkins |
| 4,270,608 | A | 6/1981 | Hendrickson |
| 4,424,859 | A | 1/1984 | Sims |
| 4,424,861 | A | 1/1984 | Carter |
| 4,442,908 | A | 4/1984 | Steenbock |
| 4,446,932 | A | 5/1984 | Hipp |

(Continued)

FOREIGN PATENT DOCUMENTS

| | | | |
|---|---|---|---|
| CA | 2820742 | A1 | 9/2013 |
| CN | 203308412 | U | 11/2013 |

(Continued)

*Primary Examiner* — Blake Michener

(74) *Attorney, Agent, or Firm* — Scott Richardson; Parker Justiss, P.C.

(57) ABSTRACT

Provided is a sealing/anchoring assembly, a well system, and a method. The sealing/anchoring assembly, in one aspect, includes a mandrel, a sealing/anchoring element positioned about the mandrel, and a setting sleeve coupled with a first end of the sealing/anchoring element. The sealing/anchoring assembly, in one aspect, further includes an internally threaded setting sleeve coupled with a second end of the sealing/anchoring element, the internally threaded setting sleeve configured to employ its internal threads to rotate and axially translate along the mandrel to move the sealing/anchoring element between a radially retracted state a radially expanded state.

20 Claims, 27 Drawing Sheets

(56) References Cited

U.S. PATENT DOCUMENTS 4,457,379 A 7/1984 McStravick
4,527,815 A 7/1985 Frick
4,760,868 A * 8/1988 Saxon ..... F16L 55/136 D23/200
4,977,636 A 12/1990 King
4,979,585 A 12/1990 Chesnutt
5,139,274 A 8/1992 Oseman
5,220,959 A 6/1993 Vance
5,424,139 A 6/1995 Shuler
5,492,173 A 2/1996 Kilgore
5,517,981 A 5/1996 Taub et al.
5,662,341 A 9/1997 Ezell et al.
5,667,015 A 9/1997 Harestad
5,803,173 A 9/1998 Fraser et al.
6,089,320 A 7/2000 LaGrange
6,106,024 A 8/2000 Herman et al.
6,840,325 B2 1/2005 Stephenson
6,907,930 B2 6/2005 Cavender
6,942,039 B2 9/2005 Tinker
7,104,322 B2 9/2006 Whanger et al.
7,152,687 B2 12/2006 Gano
7,322,408 B2 1/2008 Howlett
7,347,274 B2 3/2008 Patel
7,350,590 B2 4/2008 Hosie et al.
7,402,277 B2 7/2008 Ayer
7,578,043 B2 8/2009 Simpson et al.
7,673,688 B1 3/2010 Jones
7,677,303 B2 3/2010 Coronado
7,696,275 B2 4/2010 Slay et al.
7,963,321 B2 6/2011 Kutac
7,996,945 B2 8/2011 Nosker
8,042,841 B2 10/2011 Viegener
8,109,339 B2 2/2012 Xu
8,225,861 B2 7/2012 Foster et al.
8,266,751 B2 9/2012 He
8,430,176 B2 4/2013 Xu
8,453,736 B2 6/2013 Constantine
8,459,367 B2 6/2013 Nutley et al.
8,469,084 B2 6/2013 Clark et al.
8,490,707 B2 7/2013 Robisson
8,579,024 B2 11/2013 Mailand et al.
8,684,096 B2 4/2014 Harris
8,794,330 B2 8/2014 Stout
8,807,209 B2 8/2014 King
8,875,800 B2 11/2014 Wood et al.
8,894,070 B2 11/2014 Bhat et al.
8,993,491 B2 3/2015 James
9,004,173 B2 4/2015 Richard
9,217,311 B2 12/2015 Slup
9,249,904 B2 2/2016 Duquette
9,279,295 B2 3/2016 Williamson et al.
9,347,272 B2 5/2016 Hewson et al.
9,353,606 B2 5/2016 Bruce et al.
9,393,601 B2 7/2016 Ranck
9,404,030 B2 8/2016 Mazyar
9,534,460 B2 1/2017 Watson et al.
9,611,715 B1 4/2017 Smith
9,644,459 B2 5/2017 Themig
9,708,880 B2 7/2017 Solhaug
9,725,979 B2 8/2017 Mazyar et al.
9,732,578 B2 8/2017 McRobb
9,745,451 B2 8/2017 Zhao et al.
9,765,595 B2 9/2017 Themig et al.
9,771,510 B2 9/2017 James et al.
9,945,190 B2 4/2018 Crowley
9,976,380 B2 5/2018 Davis et al.
9,976,381 B2 5/2018 Martin et al.
10,030,467 B2 7/2018 Al-Gouhi
10,060,225 B2 8/2018 Wolf
10,119,011 B2 11/2018 Zhao et al.
10,179,873 B1 1/2019 Meng
10,215,322 B1 * 2/2019 James ..... F16L 55/1108
10,316,601 B2 6/2019 Walton et al.
10,337,298 B2 7/2019 Braddick
10,344,570 B2 7/2019 Steele
10,352,109 B2 7/2019 Sanchez
10,364,636 B2 7/2019 Davis
10,472,933 B2 11/2019 Steele
10,533,392 B2 1/2020 Walton et al.
10,718,183 B2 7/2020 Bruce et al.
10,758,974 B2 9/2020 Sherman
10,794,152 B2 10/2020 Lang et al.
10,961,804 B1 3/2021 Fripp
11,359,448 B2 6/2022 Fripp
11,365,611 B2 6/2022 Gibb
11,428,066 B2 8/2022 Andersen
11,512,552 B2 11/2022 Fripp
2002/0088616 A1 7/2002 Swor et al.
2003/0132001 A1 7/2003 Wilson
2003/0164236 A1 9/2003 Thornton
2003/0164237 A1 9/2003 Butterfield, Jr.
2003/0205377 A1 11/2003 Streater
2004/0194970 A1 10/2004 Eatwell
2005/0051333 A1 3/2005 Weber
2005/0061369 A1 3/2005 De Almeida
2005/0072576 A1 4/2005 Henriksen
2005/0093250 A1 5/2005 Santi et al.
2005/0199401 A1 9/2005 Patel et al.
2006/0144591 A1 7/2006 Gonzalez
2006/0272806 A1 12/2006 Wilkie et al.
2007/0089875 A1 4/2007 Steele et al.
2007/0089910 A1 4/2007 Hewson et al.
2007/0095532 A1 5/2007 Head
2007/0137826 A1 6/2007 Bosma et al.
2007/0144734 A1 6/2007 Xu et al.
2007/0151724 A1 7/2007 Ohmer et al.
2007/0163781 A1 7/2007 Walker
2007/0221387 A1 9/2007 Levy
2007/0246213 A1 10/2007 Hailey
2007/0267824 A1 11/2007 Baugh et al.
2007/0277979 A1 12/2007 Todd et al.
2008/0047708 A1 2/2008 Spencer
2008/0135249 A1 6/2008 Fripp
2008/0149351 A1 6/2008 Marya
2008/0290603 A1 11/2008 Laflin
2009/0014173 A1 1/2009 Macleod
2009/0084555 A1 4/2009 Lee
2009/0102133 A1 4/2009 Ruddock
2009/0159278 A1 6/2009 Corre
2009/0200028 A1 8/2009 Dewar
2009/0250227 A1 10/2009 Brown et al.
2009/0250228 A1 10/2009 Loretz
2009/0255690 A1 10/2009 Conner et al.
2009/0272546 A1 11/2009 Nutley et al.
2009/0321087 A1 12/2009 Victorov
2010/0072711 A1 3/2010 Doane
2010/0078173 A1 4/2010 Buytaert et al.
2010/0096143 A1 4/2010 Angman
2010/0108148 A1 5/2010 Chen
2010/0122819 A1 5/2010 Wildman
2010/0139930 A1 6/2010 Patel
2010/0155083 A1 6/2010 Lynde et al.
2010/0181080 A1 7/2010 Levy
2010/0225107 A1 9/2010 Tverlid
2010/0257913 A1 10/2010 Storm, Jr. et al.
2010/0307737 A1 12/2010 Mellemstrand
2011/0061876 A1 3/2011 Johnson et al.
2011/0098202 A1 4/2011 James
2011/0147014 A1 6/2011 Chen et al.
2011/0278022 A1 11/2011 Holstad
2012/0018143 A1 1/2012 Lembcke
2012/0048531 A1 3/2012 Marzouk
2012/0048561 A1 3/2012 Holderman
2012/0048623 A1 3/2012 Lafuente et al.
2012/0049462 A1 3/2012 Pitman
2012/0168147 A1 7/2012 Bowersock
2012/0175134 A1 7/2012 Robisson
2012/0273236 A1 11/2012 Gandikota et al.
2013/0048289 A1 2/2013 Mazyar et al.
2013/0056207 A1 3/2013 Wood et al.
2013/0081815 A1 4/2013 Mazyar et al.
2013/0152824 A1 6/2013 Crews
2013/0153236 A1 6/2013 Bishop
2013/0161006 A1 6/2013 Robisson et al.

(56) References Cited

U.S. PATENT DOCUMENTS

2013/0186615 A1 7/2013 Hallunbaek et al.
2013/0192853 A1 8/2013 Themig
2013/0292117 A1 11/2013 Robisson
2014/0026335 A1 1/2014 Smith
2014/0034308 A1 2/2014 Holderman
2014/0051612 A1 2/2014 Mazyar
2014/0262352 A1 9/2014 Lembcke
2015/0021049 A1 1/2015 Davis et al.
2015/0053428 A1* 2/2015 Xu ..... E21B 33/128 166/387
2015/0075768 A1 3/2015 Wright et al.
2015/0101813 A1 4/2015 Zhao
2015/0113913 A1 4/2015 Kim
2015/0184486 A1 7/2015 Epstein
2015/0233190 A1 8/2015 Wolf et al.
2015/0267491 A1 9/2015 Bergland et al.
2015/0275587 A1 10/2015 Wolf et al.
2015/0337615 A1 11/2015 Epstein et al.
2015/0345248 A1 12/2015 Carragher
2015/0368990 A1 12/2015 Jewett
2015/0369003 A1 12/2015 Hajjari et al.
2016/0024896 A1 1/2016 Johnson et al.
2016/0024902 A1 1/2016 Richter
2016/0137912 A1 5/2016 Sherman et al.
2016/0138359 A1 5/2016 Zhao
2016/0145488 A1 5/2016 Aines et al.
2016/0145968 A1 5/2016 Marya
2016/0177668 A1 6/2016 Watson et al.
2016/0194936 A1 7/2016 Allen
2016/0208569 A1 7/2016 Anderson et al.
2016/0230495 A1 8/2016 Mazyar et al.
2016/0273312 A1 9/2016 Steele et al.
2016/0319633 A1 11/2016 Cooper et al.
2016/0326830 A1 11/2016 Hallundbaek
2016/0326849 A1 11/2016 Bruce
2016/0333187 A1 11/2016 Bauer et al.
2017/0015824 A1 1/2017 Gozalo
2017/0022778 A1 1/2017 Fripp et al.
2017/0107419 A1 4/2017 Roy et al.
2017/0107794 A1 4/2017 Steele
2017/0113275 A1 4/2017 Roy et al.
2017/0159401 A1 6/2017 Saltel et al.
2017/0175487 A1 6/2017 Marcin et al.
2017/0175488 A1 6/2017 Lisowski
2017/0191342 A1 7/2017 Turley
2017/0198191 A1 7/2017 Potapenko
2017/0234103 A1 8/2017 Frazier
2017/0275962 A1 9/2017 Conzemius et al.
2017/0306714 A1 10/2017 Haugland
2017/0314372 A1 11/2017 Tolman
2017/0350237 A1 12/2017 Giem et al.
2017/0356266 A1 12/2017 Arackakudiyil
2018/0023362 A1 1/2018 Makowiecki et al.
2018/0023366 A1 1/2018 Deng et al.
2018/0038193 A1 2/2018 Walton
2018/0080304 A1 3/2018 Cortez et al.
2018/0081468 A1 3/2018 Bruce et al.
2018/0086894 A1 3/2018 Roy
2018/0087350 A1 3/2018 Sherman
2018/0094508 A1 4/2018 Smith et al.
2018/0100367 A1 4/2018 Perez
2018/0128072 A1 5/2018 Larsen
2018/0128082 A1 5/2018 Hollan et al.
2018/0209234 A1 7/2018 Manera
2018/0223624 A1 8/2018 Fripp
2018/0298708 A1 10/2018 Schmidt et al.
2018/0298716 A1* 10/2018 Cayson ..... E21B 33/1293
2018/0334882 A1 11/2018 Brandsdal
2018/0347288 A1 12/2018 Fripp
2018/0363409 A1 12/2018 Frazier
2019/0016951 A1 1/2019 Sherman et al.
2019/0032435 A1 1/2019 Kochanek et al.
2019/0039126 A1 2/2019 Sherman
2019/0078414 A1 3/2019 Frazier
2019/0128092 A1 5/2019 Mueller et al.
2019/0136666 A1 5/2019 Kent
2019/0178054 A1 6/2019 Bruce
2019/0186228 A1 6/2019 Beckett et al.
2019/0225861 A1 7/2019 Reddy
2019/0249510 A1 8/2019 Deng et al.
2019/0316025 A1 10/2019 Sherman
2019/0383115 A1 12/2019 Lees
2020/0032574 A1 1/2020 Fripp et al.
2020/0056435 A1 2/2020 Sherman
2020/0072019 A1 3/2020 Onti et al.
2020/0080401 A1 3/2020 Sherman
2020/0080402 A1 3/2020 Lang et al.
2020/0240235 A1 7/2020 Fripp et al.
2020/0308945 A1 10/2020 Surjaatmadja et al.
2020/0325749 A1 10/2020 Fripp et al.
2020/0362224 A1 11/2020 Wellhoefer
2020/0370391 A1 11/2020 Fripp et al.
2021/0017835 A1 1/2021 Pelto et al.
2021/0040810 A1 2/2021 Evers
2021/0123310 A1 4/2021 Fripp et al.
2021/0123319 A1 4/2021 Greci
2021/0172286 A1 6/2021 Barlow
2021/0187604 A1 6/2021 Sherman et al.
2021/0230980 A1* 7/2021 Steele ..... E21B 41/0085
2021/0270093 A1 9/2021 Fripp
2021/0270103 A1 9/2021 Greci et al.
2021/0332673 A1 10/2021 Fripp
2021/0363849 A1 11/2021 Al Yahya
2022/0106847 A1 4/2022 Dahl
2022/0186575 A1 6/2022 Fripp
2022/0205336 A1 6/2022 Asthana
2022/0372837 A1 11/2022 Holderman et al.

FOREIGN PATENT DOCUMENTS

CN 205422632 U 8/2016
CN 107148444 A 9/2017
CN 108194756 A 6/2018
CN 107148444 B 1/2019
CN 108194756 B 8/2020
EP 15726 A1 9/1980
EP 869257 A2 10/1998
EP 940558 A1 9/1999
EP 0940558 B1 1/2005
EP 1757770 A1 2/2007
EP 1910728 A1 4/2008
EP 1910728 B1 9/2009
EP 2447466 A2 5/2012
EP 2501890 A2 9/2012
EP 2501890 B 7/2014
EP 2447466 A3 3/2017
EP 3144018 A1 3/2017
EP 3144018 A4 5/2017
EP 3196402 A1 7/2017
EP 3144018 B1 9/2018
EP 2447466 B1 10/2018
GB 2444060 A 5/2008
GB 2444060 B 12/2008
JP 2003090037 A 3/2003
JP 2003293354 A 10/2003
JP 2004169303 A 6/2004
JP 2015175449 A 10/2015
KR 20020014619 A 2/2002
KR 20080096576 A 10/2008
WO 02/02900 A2 1/2002
WO 02/02900 A3 5/2002
WO 02/02900 A8 12/2003
WO 2005/022012 A1 3/2005
WO 2006/045794 A1 5/2006
WO 2007/047089 A1 4/2007
WO 2012/094322 A2 7/2012
WO 2012/125660 A2 9/2012
WO 2012/094322 A3 10/2012
WO 2012/125660 A3 2/2013
WO 2014/028149 A1 2/2014
WO 2014/182301 A1 11/2014
WO 2014/193042 A1 12/2014
WO 2015/057338 A1 4/2015
WO 2015/069886 A2 5/2015

(56) References Cited

FOREIGN PATENT DOCUMENTS

| | | | |
|---|---|---|---|
| WO | 2015/069886 | A3 | 9/2015 |
| WO | 2015/183277 | A1 | 12/2015 |
| WO | 2016/000068 | A1 | 1/2016 |
| WO | 2016/171666 | A1 | 10/2016 |
| WO | 2017/100417 | A1 | 6/2017 |
| WO | 2018/055382 | A1 | 3/2018 |
| WO | 2019/094044 | A1 | 5/2019 |
| WO | 2019/122857 | A1 | 6/2019 |
| WO | 2019/147285 | A1 | 8/2019 |
| WO | 2019/151870 | A1 | 8/2019 |
| WO | 2019/164499 | A1 | 8/2019 |
| WO | 2020/005252 | A1 | 1/2020 |
| WO | 2020/141203 | A1 | 7/2020 |
| WO | 2019/164499 | A8 | 8/2020 |
| WO | 2020/167288 | A1 | 8/2020 |
| WO | 2020/204940 | A1 | 10/2020 |
| WO | 2021/034325 | A1 | 2/2021 |
| WO | 2021/086317 | A1 | 5/2021 |
| WO | 2021/096519 | A1 | 5/2021 |
| WO | 2021/126279 | A1 | 6/2021 |
| WO | 2022220792 | A1 | 10/2022 |

* cited by examiner

400

400

REDUCED BACKLASH SEALING/ANCHORING ASSEMBLY

BACKGROUND

A typical sealing tool (e.g., packer, bridge plug, frac plug, etc.) generally has one or more sealing elements or "rubbers" that are employed to provide a fluid-tight seal radially between a mandrel of the sealing tool, and the casing or wellbore into which the sealing tool is disposed. Such a sealing tool is commonly conveyed into a subterranean wellbore suspended from tubing extending to the earth's surface.

To prevent damage to the elements of the sealing tool while the sealing tool is being conveyed into the wellbore, the sealing elements may be carried on the mandrel in a retracted or uncompressed state, in which they are radially inwardly spaced apart from the casing. When the sealing tool is set, the sealing elements radially expand, thereby sealing against the mandrel and the casing and/or wellbore. In certain embodiments, the sealing elements are axially compressed between element retainers that straddle them, which in turn radially expand the sealing elements.

BRIEF DESCRIPTION

Reference is now made to the following descriptions taken in conjunction with the accompanying drawings, in which.

Figure 1:
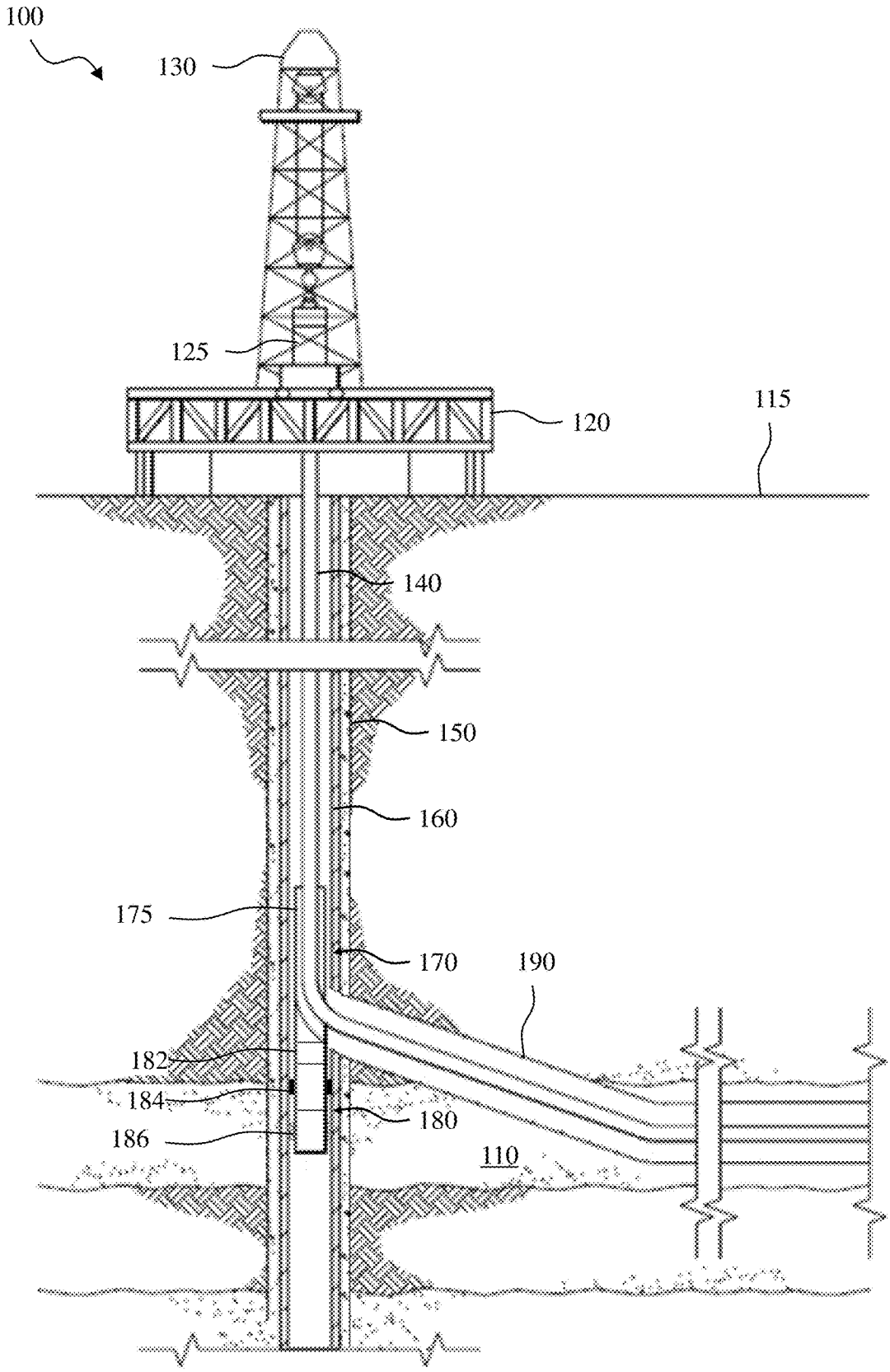
FIG. 1 illustrates a schematic view of a well system designed, manufactured and operated according to one or more embodiments disclosed herein.

FIGS. 4A through 4G illustrate different cross-sectional views of various deployment states of a sealing/anchoring assembly designed, manufactured and/or operated according to one or more alternative embodiments of the disclosure; and FIGS. 5A through 5E illustrate different cross-sectional views of various deployment states of a sealing/anchoring assembly designed, manufactured and/or operated according to one or more alternative embodiments of the disclosure.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect." "engage," "couple," "attach," or any other like term describing an interaction between elements is not meant to limit the interaction to direct interaction between the elements and may also include indirect interaction between the elements described. Unless otherwise specified, use of the terms "up," "upper." "upward." "uphole." "upstream," or other like terms shall be construed as generally away from the bottom, terminal end of a well; likewise, use of the terms "down," "lower," "downward," "downhole." "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Body lock rings are traditionally a critical part of a scaling tool, for example used to hold the setting load once the sealing elements of the sealing tool are set, and prior to differential pressure application. The present disclosure, however, has acknowledged that backlash or set back of the body lock ring is an inherent drawback of common locking systems. This back lash or set back often results in reduction in setting force and relaxation of the sealing elements, which eventually affects the sealing element performance, particularly for large size sealing tools (e.g., the larger the back lash the bigger reduction in setting force). Similar problems may occur in anchoring tools employing body lock rings.

Given the foregoing acknowledgments, the present disclosure has designed a new scaling/anchoring assembly that does away with the conventional body lock ring system. For example, the new sealing/anchoring assembly employs an internally threaded setting sleeve that is coupled to a rotary motor. Accordingly, as the rotary motor rotates about the mandrel, the internally threaded setting sleeve rotates and axially translates along the mandrel to axially compress the sealing/anchoring elements, and thus move them from their radially retracted state to their radially expanded state. In the case of a sealing assembly, the sealing elements would radially expand to seal an annulus between the mandrel and a surrounding tubular (e.g., wellbore casing). In the case of an anchoring assembly, the anchoring elements would radially expand to engage the surrounding tubular (e.g., wellbore casing), and thus axially fix the mandrel relative to the surrounding tubular. In contrast to conventional body lock rings, the threaded setting sleeve does not have significant issues (e.g., any issues) with back lash or set back.

A reduced backlash sealing/anchoring assembly according to the disclosure is based on a simple idea of using rotary motor (e.g., hydraulic or electrical rotary motor), instead of a conventional hydraulic piston, to torque an internally threaded setting sleeve running on an externally threaded mandrel and pushing against the element backup system to set the scaling element. Once the sealing element is set, the rotary motor can be retrieved and pulled back. Once the rotary motor is retrieved, the threaded sleeve is axially locked in its position through the threaded connection with mandrel resulting in limited back lash (e.g., literally zero back lash). In other words, the setting axial force is resisted by the threaded connection where there is no axial set back (back lash) because the threaded connection cannot be un-torqued by the scaling element reaction. To release and retrieve the sealing element, the rotary motor will be used with reversed rotation to un-torque the setting sleeve and unload the sealing element.

Certain main components in this concept are the internally threaded setting sleeve and the rotary motor. The mandrel is only partially threaded at OD within the travel length of the internally threaded setting sleeve, which is equal or larger than the sealing element setting stroke length. Unlike conventional systems, a sealing/anchoring assembly according to the present disclosure may be void of a body lock ring or slip biting mechanism.

In at least one embodiment, the rotary motor torques the internally threaded setting sleeve through a male-to-female connections at the interface. In one embodiment, the tip of the rotary motor has male connections with protruded parts while the back end of the internally threaded setting sleeve has female connections with recessed parts. Such male-to-female connection is only used for torque-and-push mechanism. Once the sealing element is set, the rotary motor is simply pulled back and disconnected from the internally threaded setting sleeve. As mentioned, in at least one embodiment the mandrel is only partially threaded at OD within the travel length of the internally threaded setting sleeve, which is equal or larger than sealing element stroke length. To release the locking system and the sealing element, the internally threaded setting sleeve is untortured by reversing the rotary mechanism.

FIG. 1 is a schematic view of a well system 100 designed, manufactured and operated according to one or more embodiments disclosed herein. The well system 100 includes a platform 120 positioned over a subterranean formation 110 located below the earth's surface 115. The platform 120, in at least one embodiment, has a hoisting apparatus 125 and a derrick 130 for raising and lowering one or more downhole tools including pipe strings, such as a drill string 140. Although a land-based oil and gas platform 120 is illustrated in FIG. 1, the scope of this disclosure is not thereby limited, and thus could potentially apply to offshore applications. The teachings of this disclosure may also be applied to other land-based well systems different from that illustrated.

As shown, a main wellbore 150 has been drilled through the various earth strata, including the subterranean formation 110. The term "main" wellbore is used herein to designate a wellbore from which another wellbore is drilled. It is to be noted, however, that a main wellbore 150 does not necessarily extend directly to the earth's surface, but could instead be a branch of yet another wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

In the embodiment of FIG. 1, a whipstock assembly 170 according to one or more embodiments of the present disclosure is positioned at a location in the main wellbore 150. Specifically, the whipstock assembly 170 could be placed at a location in the main wellbore 150 where it is desirable for a lateral wellbore 190 to exit. Accordingly, the whipstock assembly 170 may be used to support a milling tool used to penetrate a window in the main wellbore 150, and once the window has been milled and a lateral wellbore 190 formed, in some embodiments, the whipstock assembly 170 may be retrieved and returned uphole by a retrieval tool.

The whipstock assembly 170, in at least one embodiment, includes a whipstock element section 175, as well as a sealing/anchoring assembly 180 coupled to a downhole end thereof. The sealing/anchoring assembly 180, in one or more embodiments, includes an orienting receptacle tool assembly 182, a sealing assembly 184, and an anchoring assembly 186. In at least one embodiment, the anchoring assembly 186 axially, and optionally rotationally, fixes the whipstock assembly 170 within the casing string 160. The sealing assembly 184, in at least one embodiment, seals (e.g., provides a pressure tight seal) an annulus between the whipstock assembly 170 and the casing string 160. The orienting receptacle tool assembly 182, in one or more embodiments, along with a collet and one or more orienting keys, may be used to land and positioned a guided milling assembly and/or the whipstock element section 175 within the casing string 160.

The elements of the whipstock assembly 170 may be positioned within the main wellbore 150 in one or more separate steps. For example, in at least one embodiment, the scaling/anchoring assembly 180, including the orienting receptacle tool assembly 182, sealing assembly 184 and the anchoring assembly 186 are run in hole first, and then set within the casing string 160. Thereafter, the sealing assembly 184 may be pressure tested. Thereafter, the whipstock element section 175 may be run in hole and coupled to the sealing/anchoring assembly 180, for example using the orienting receptacle tool assembly 182. What may result is the whipstock assembly 170 illustrated in FIG. 1.

Turning now to FIGS. 2A through 2G, illustrated are different cross-sectional views of various deployment states of a sealing/anchoring assembly 200 designed, manufactured and/or operated according to one or more embodiments of the disclosure. The scaling/anchoring assembly 200, in the illustrated embodiment of FIGS. 2A through 2G, includes a mandrel 210. The mandrel 210, in the illustrated embodiment, is centered about a centerline (CL). The scaling/anchoring assembly 200, in at least the embodiment of FIGS. 2A through 2G, additionally includes a bore 290 positioned around the mandrel 210. The bore 290, in at least one embodiment, is a wellbore. The bore 290, in at least one other embodiment, is a tubular positioned within a wellbore, such as a casing, production tubing, etc. In accordance with one aspect of the disclosure, the mandrel 210 and the bore 290 form an annulus 280.

In accordance with one embodiment of the disclosure, the sealing/anchoring assembly 200 includes one or more sealing/anchoring elements 220 (e.g., one or more elastomeric scaling/anchoring elements) having a first end 225*a* and a second end 225*b* positioned about the mandrel 210. The one or more sealing/anchoring elements 220 are operable to move between a radially retracted state, such as that shown in FIG. 2A, and a radially expanded state, such as that shown in FIGS. 2B through 2G. While a single sealing/anchoring element 220 is illustrated in FIGS. 2A through 2G, other embodiments exist wherein multiple sealing/anchoring elements 220 are employed. In the embodiment of FIGS. 2A through 2G, the one or more sealing/anchoring elements 220 comprise a non-swellable elastomer.

In the illustrated embodiment of FIGS. 2A through 2G, first and second backup shoes 230*a*, 230*b*, straddle the first and second ends 225*a*, 225*b*, respectively, of the one or more scaling/anchoring elements 220. Further to the embodiment of FIGS. 2A through 2G, first and second collar sleeves

240*a*, 240*b* straddle the first and second backup shoes 230*a*, 230*b*, respectively. In at least one embodiment, the first and second collar sleeves 240*a*, 240*b* are non-threaded first and second collar sleeves. In the embodiment of FIGS. 2A through 2G, a setting sleeve 250 (e.g., an axially fixed setting sleeve) is coupled with the first end 225*a* of the one or more sealing/anchoring elements 220 (e.g., through the first backup shoe 230*a* and first collar sleeve 240*a*). Those skilled in the art understand and appreciate the desire and/or need for the first and second backup shoes 230*a*. 230*b*, including preventing extrusion of the one or more scaling/anchoring elements 220. Similarly, those skilled in the art appreciate the desire and/or need for the first and second collar sleeves 240*a*, 240*b*. For example, in the illustrated embodiment of FIGS. 2A through 2G, the first and second collar sleeves 240*a*, 240*b* are configured to axially slide relative to one another to move the one or more sealing/anchoring elements 220 between the radially retracted state of FIG. 2A and the radially expanded state of FIGS. 2B through 2G.

The sealing/anchoring assembly 200 of FIGS. 2A through 2G additionally includes an internally threaded setting sleeve 260 coupled with the second end 225*b* of the sealing/anchoring element 220 (e.g., through the second backup shoe 230*b* and second collar sleeve 240*b*). In the illustrated embodiment, the internally threaded setting sleeve 260 is configured to employ its internal threads 265 to rotate and axially translate along the mandrel 210, to move the sealing/anchoring element between the radially retracted state of FIG. 2A and the radially expanded state of FIGS. 2B through 2G. For example, in the embodiment of FIGS. 2A through 2G, the mandrel 210 has reciprocal external threads 215. Accordingly, the internal threads 265 of the internally threaded setting sleeve 260 are configured to engage with the external threads 215 of the mandrel 210 to move the sealing/anchoring element 220 between the radially retracted state of FIG. 2A and the radially expanded state of FIGS. 2B through 2G.

The sealing/anchoring assembly 200 of FIGS. 2A through 2G additionally includes a rotary motor 270 coupled to the internally threaded setting sleeve 260. In the illustrated embodiment, the rotary motor 270 (e.g., hydraulic rotary motor, radial piston hydraulic rotary motor, electric rotary motor, etc.) is configured to rotate and axially translate the internally threaded setting sleeve 260 to move the one or more sealing/anchoring elements 220 between the radially retracted state of FIG. 2A and the radially expanded state of FIGS. 2B through 2G. For example, in the illustrated embodiment, the rotary motor 270 is configured to rotate and axially translate the internally threaded setting sleeve 260 to shorten a distance between the internally threaded setting sleeve 260 and the setting sleeve 250 (e.g., axially fixed setting sleeve) thereby compressing the one or more sealing/anchoring elements 220 into the radially expanded state of FIGS. 2B through 2G.

In one or more embodiments, the rotary motor 270 has one of a male member or female member, and the internally threaded setting sleeve 260 has the other of the female member or the male member. Accordingly, the male and female members are configured to engage one another to rotationally fix the rotary motor 270 with the internally threaded setting sleeve 260. In the embodiment of FIGS. 2A through 2G, the rotary motor 270 has one or more male members 278 on a downhole face thereof and the internally threaded setting sleeve 260 has one or more female members 268 on an uphole face thereof, the one or more male members 278 of the rotary motor 270 configured to engage with the one or more female members 268 of the internally threaded setting sleeve 260 to rotationally fix the rotary motor 270 with the internally threaded setting sleeve 260. However, other embodiments may exist wherein the rotary motor has one or more female members and the internally threaded setting sleeve 260 has one or more male members, such as shown in FIG. 2H.

Figure 2A:
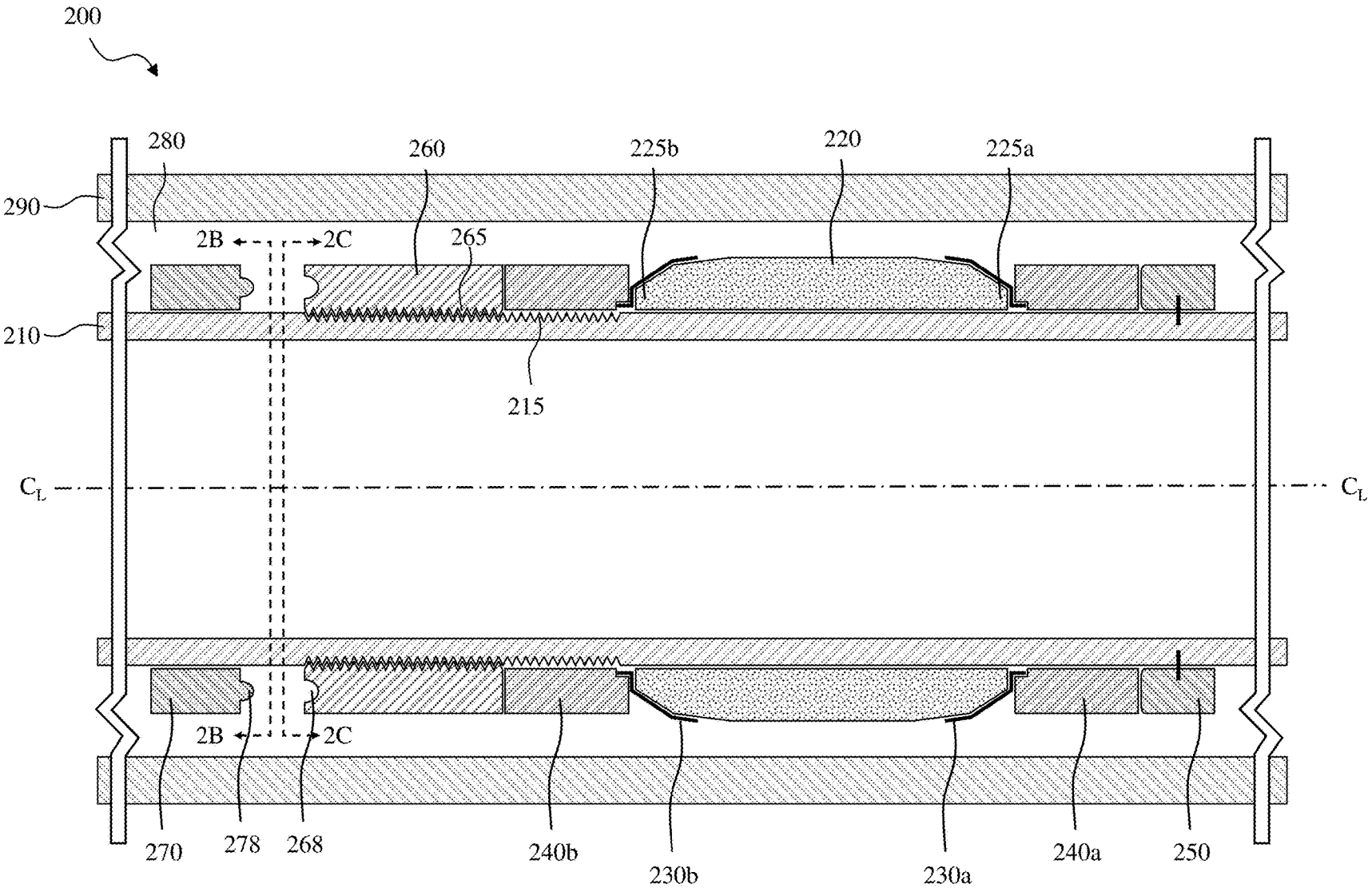
FIGS. 2A through 2H illustrate different cross-sectional views of various deployment states of a sealing/anchoring assembly designed, manufactured and/or operated according to one or more embodiments of the disclosure.
Figure 2C:
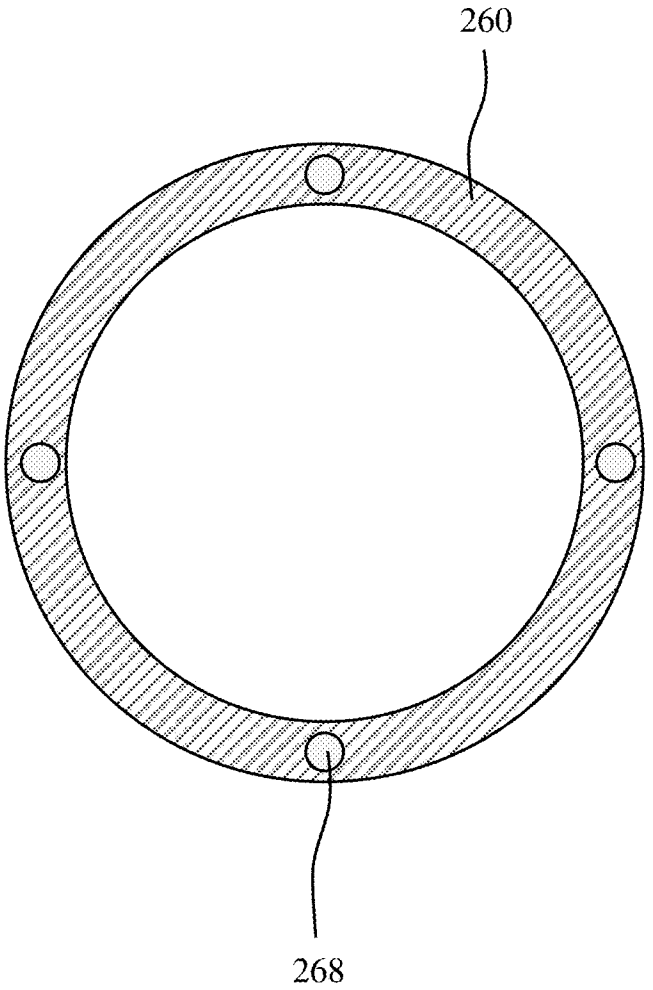
Figure 2B:
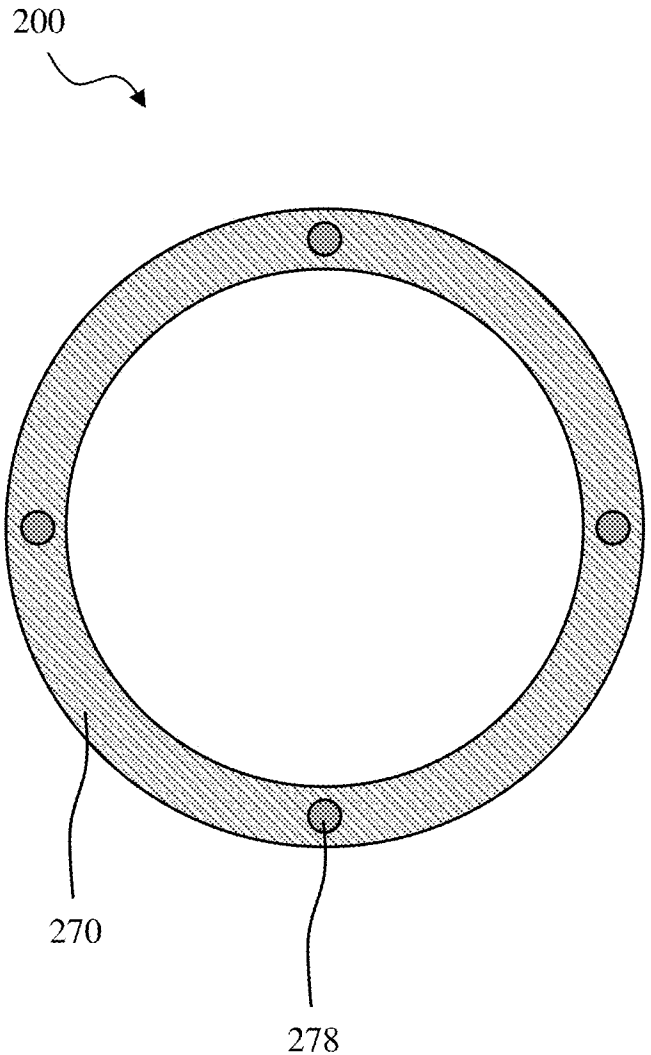
Figure 2D:
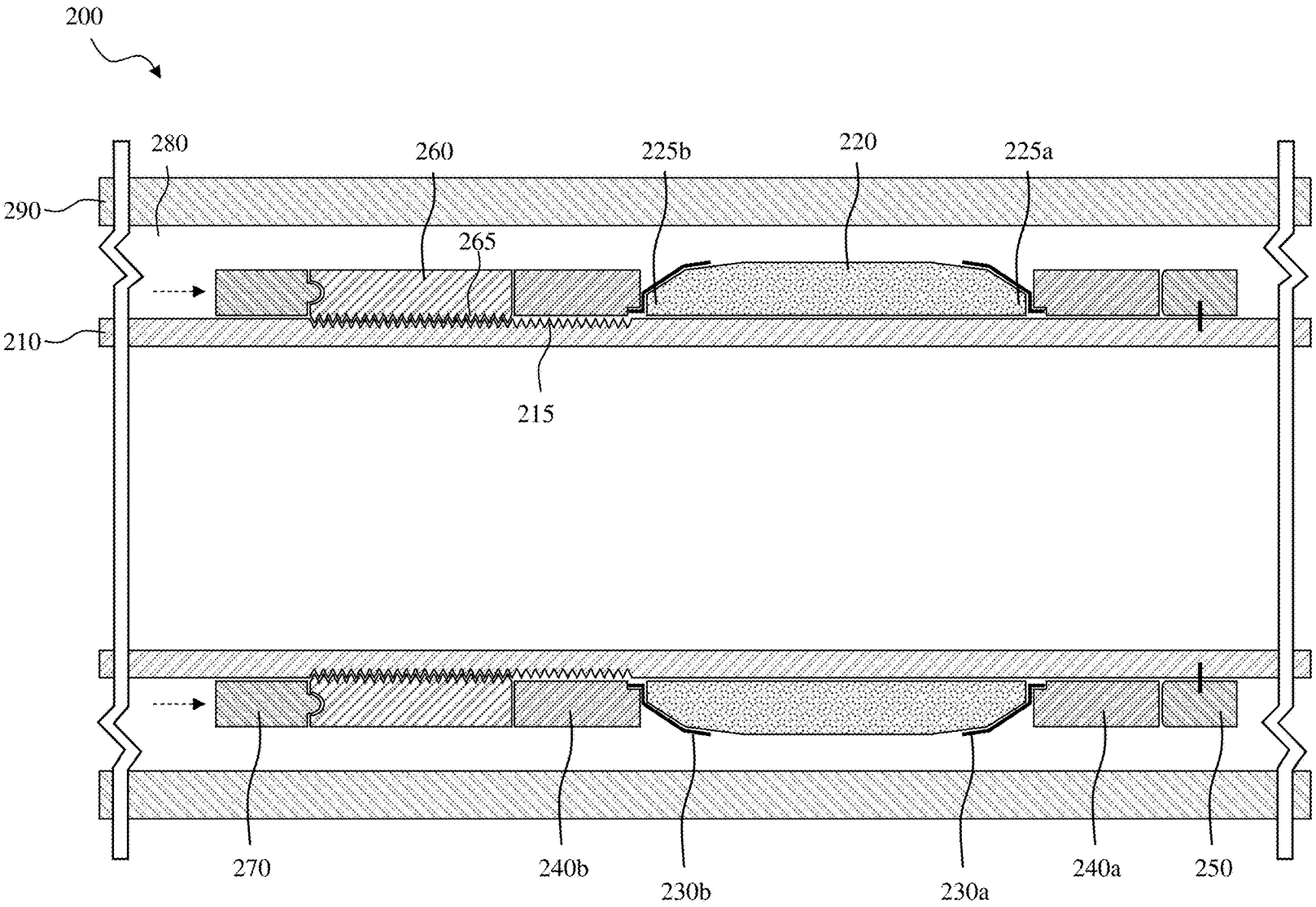
Figure 2E:
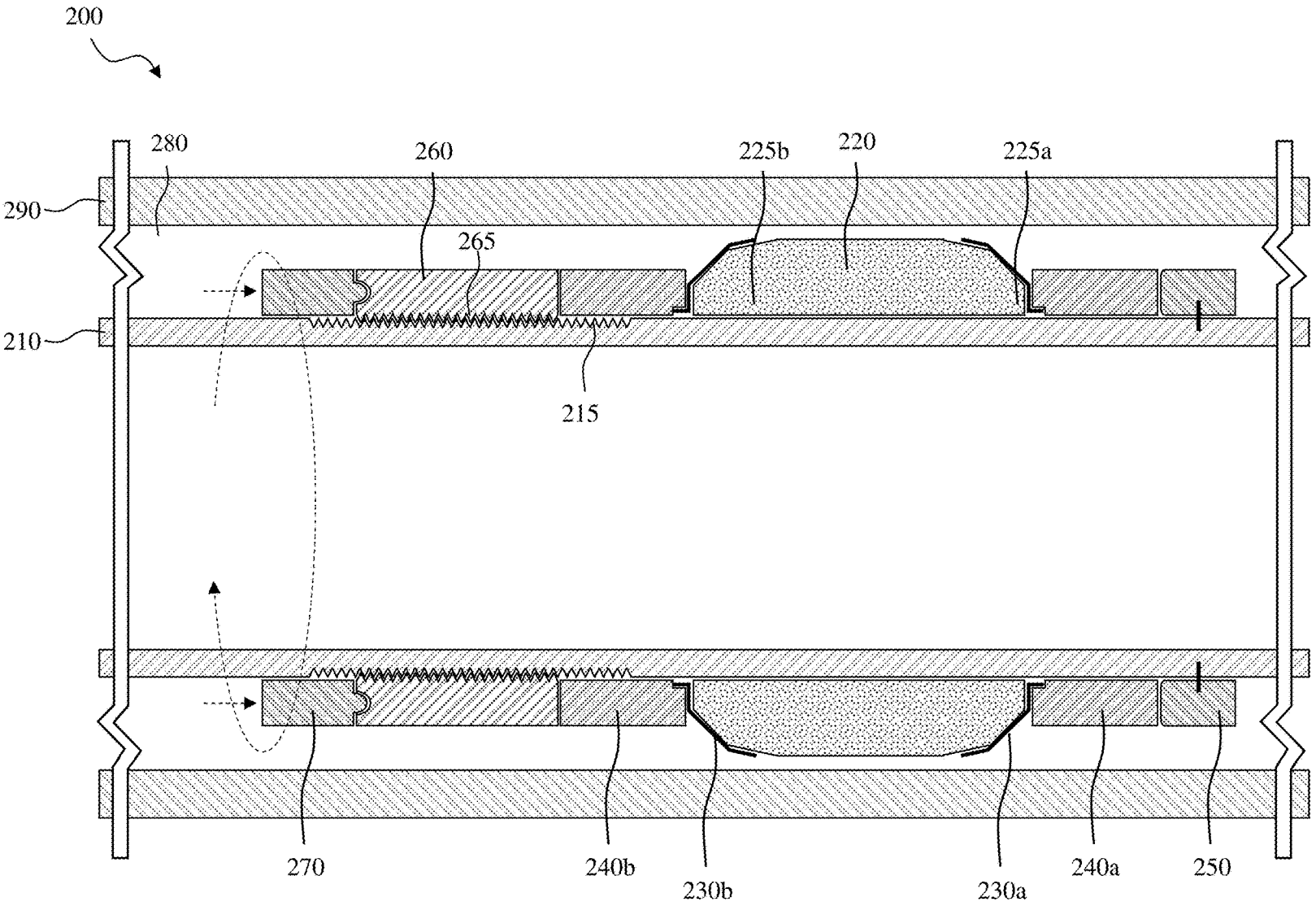
Figure 2F:
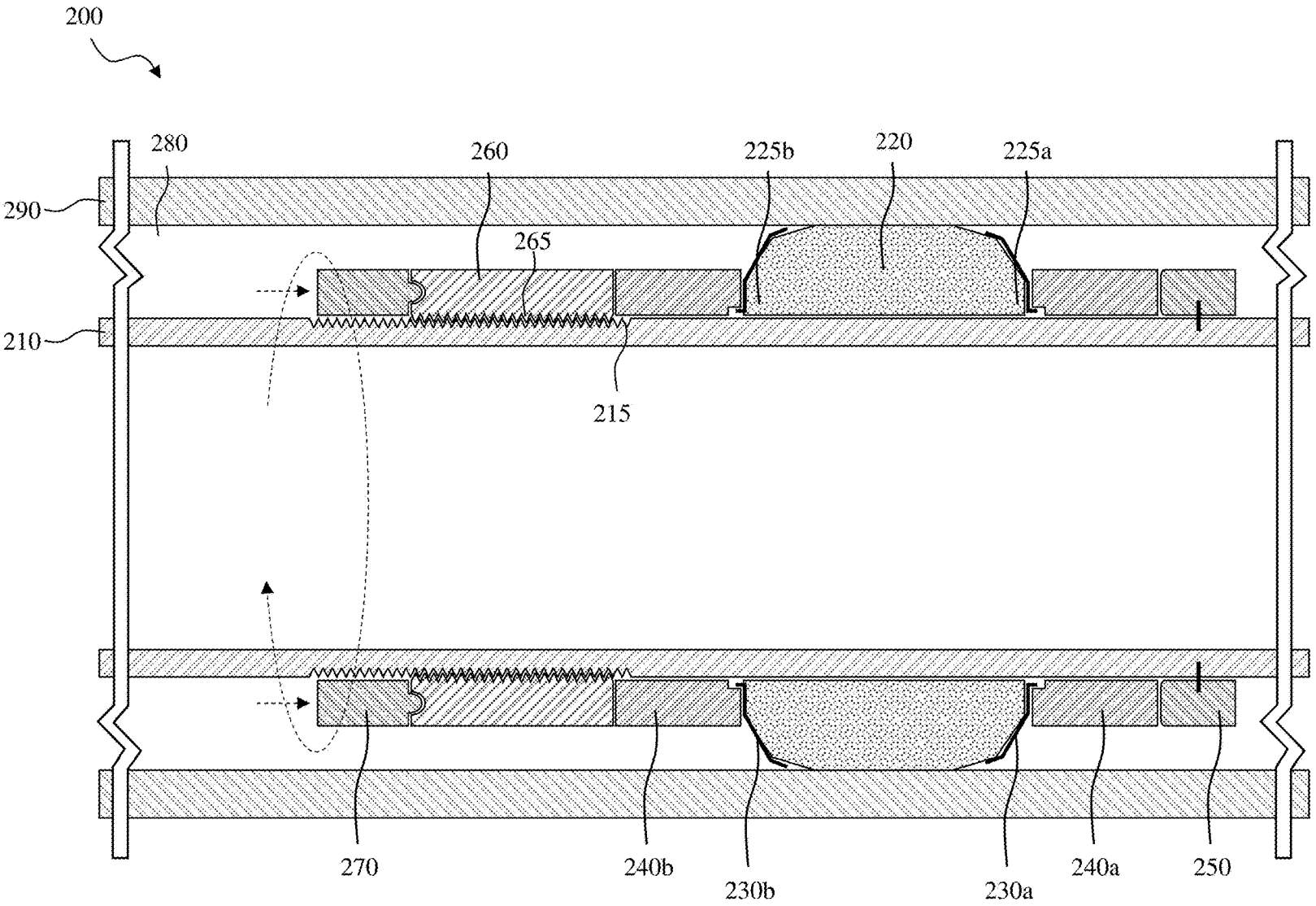
Figure 2G:
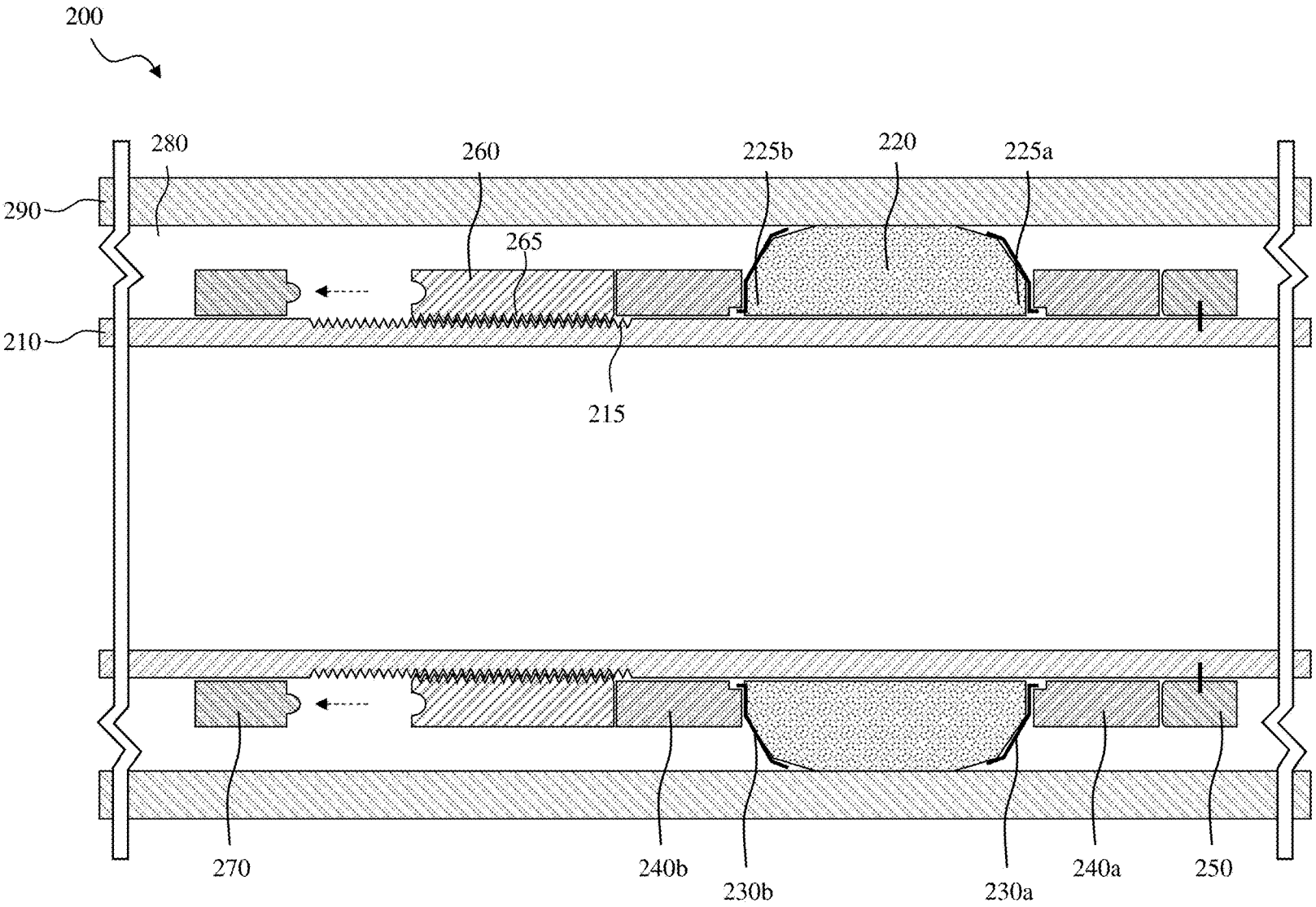
Figure 2H:
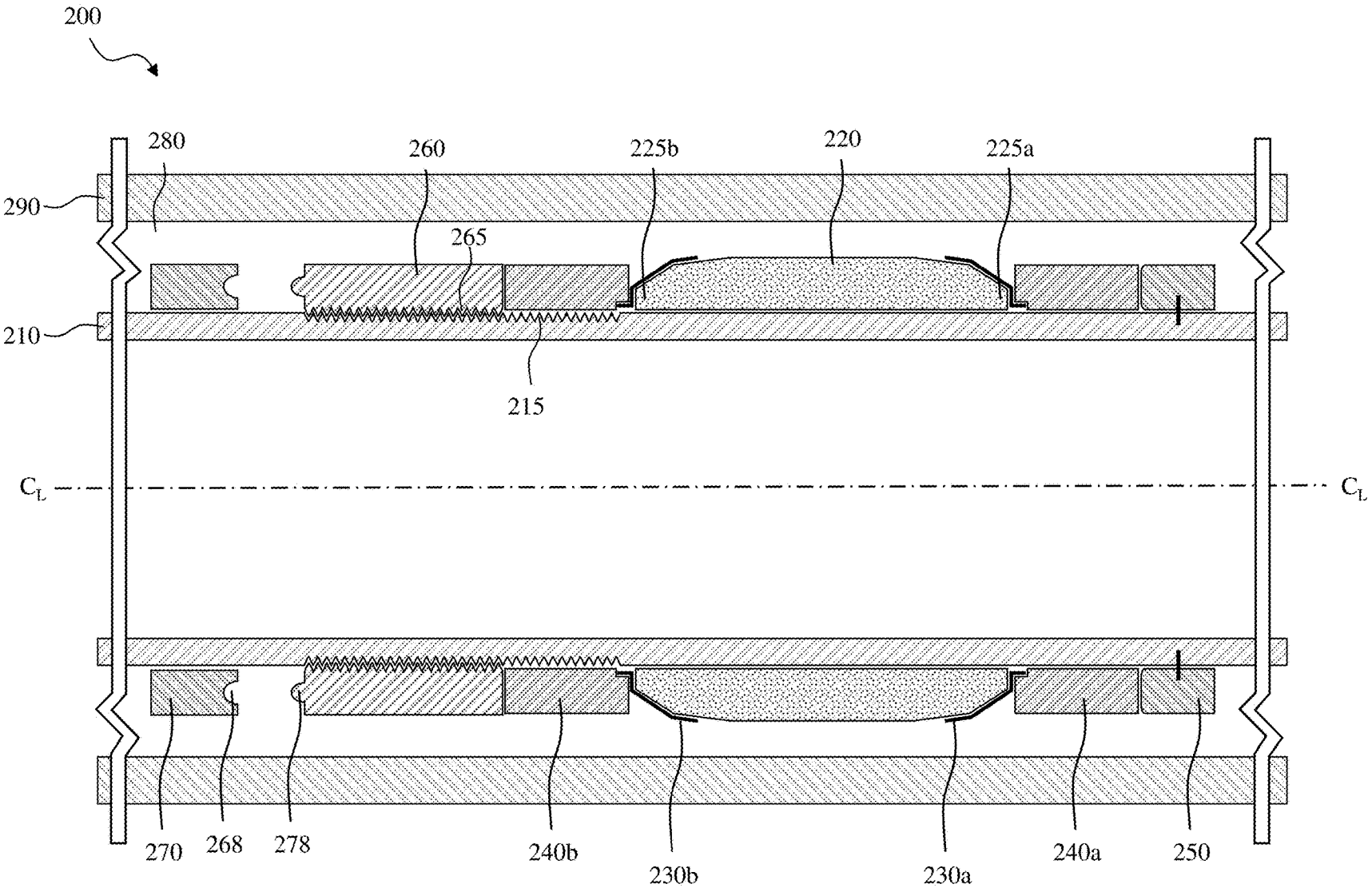

FIG. 2A illustrates the sealing/anchoring assembly 200 in a run-in-hole state, and thus its scaling/anchoring element 220 is in a radially retracted state. FIGS. 2B and 2C illustrate cross-sectional views of the rotary motor 270 and internally threaded setting sleeve 260, respectively. FIG. 2D illustrates the sealing/anchoring assembly 200 as the rotary motor 270 has engaged the internally threaded setting sleeve 260. FIG. 2E illustrates the sealing/anchoring assembly 200 after the rotary motor 270 begins to rotate and axially translate the internally threaded setting sleeve 260. FIG. 2F illustrates the sealing/anchoring assembly 200 after the sealing/anchoring element 220 is in its fully radially expanded state. FIG. 2G illustrates the sealing/anchoring assembly 200 after the rotary motor 270 has disengaged from the internally threaded setting sleeve 260. As discussed above, the threads 265 of the internally threaded setting sleeve 260, and in the embodiment of FIGS. 2A through 2G the threads 265 of the internally threaded setting sleeve 260 along with the external threads 215 in the mandrel 210, help reduce (e.g., prevent) the back lash or set back issues disclosed above. Moreover, if necessary, the rotary motor 270 could reengage the internally threaded setting sleeve 260 while rotating in an opposite direction to move the one or more sealing/anchoring elements 220 from the radially expanded state back to the radially retracted state.

While the embodiment of FIGS. 2A through 2G is configured as a scaling assembly employing one or more different sealing elements, other embodiments exist wherein the scaling/anchoring assembly is an anchoring assembly employing one or more different anchoring elements.

Figure 3A:
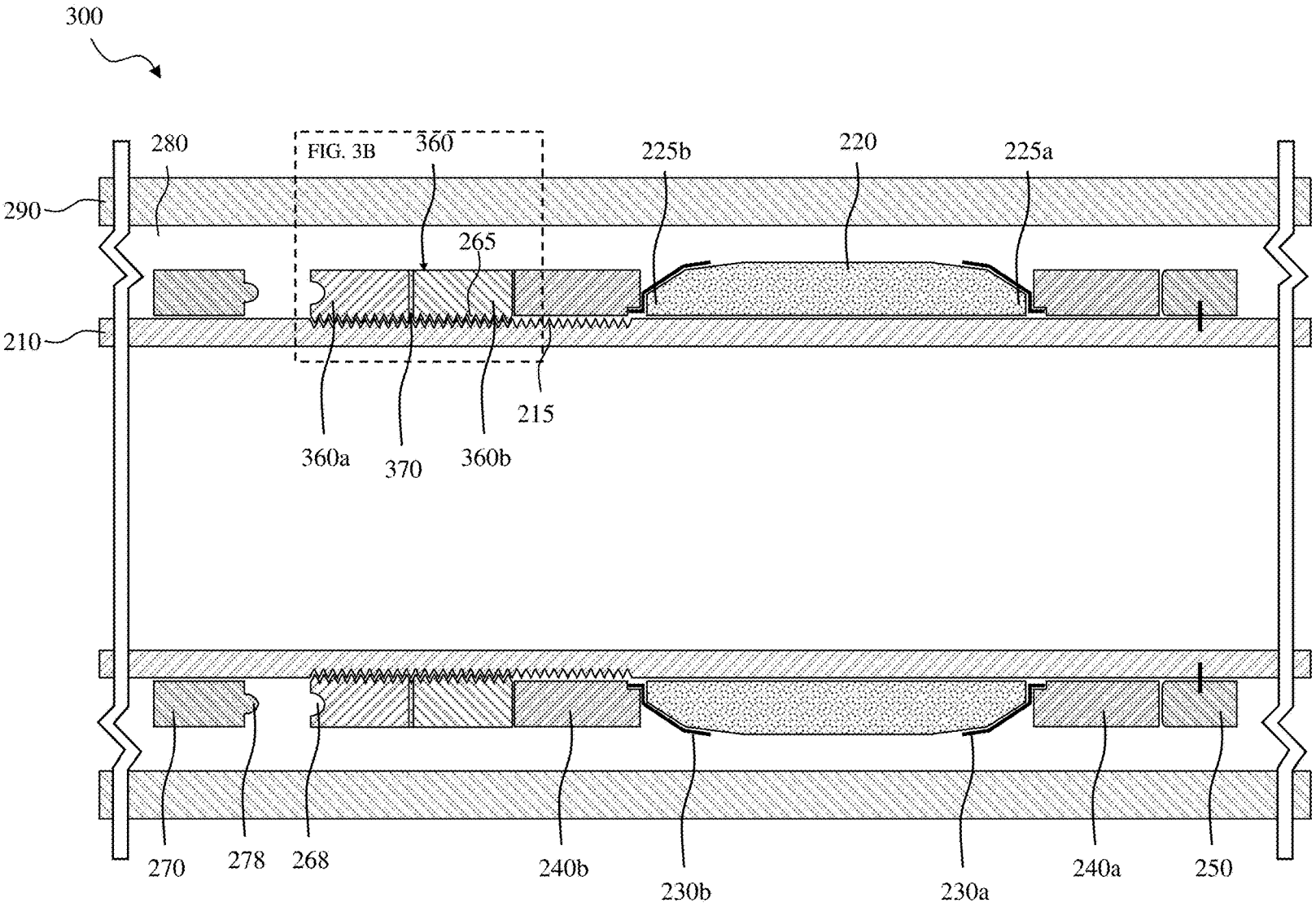
FIGS. 3A through 3G illustrate different cross-sectional views of various deployment states of a sealing/anchoring assembly designed, manufactured and/or operated according to one or more alternative embodiments of the disclosure.
Figure 3B:
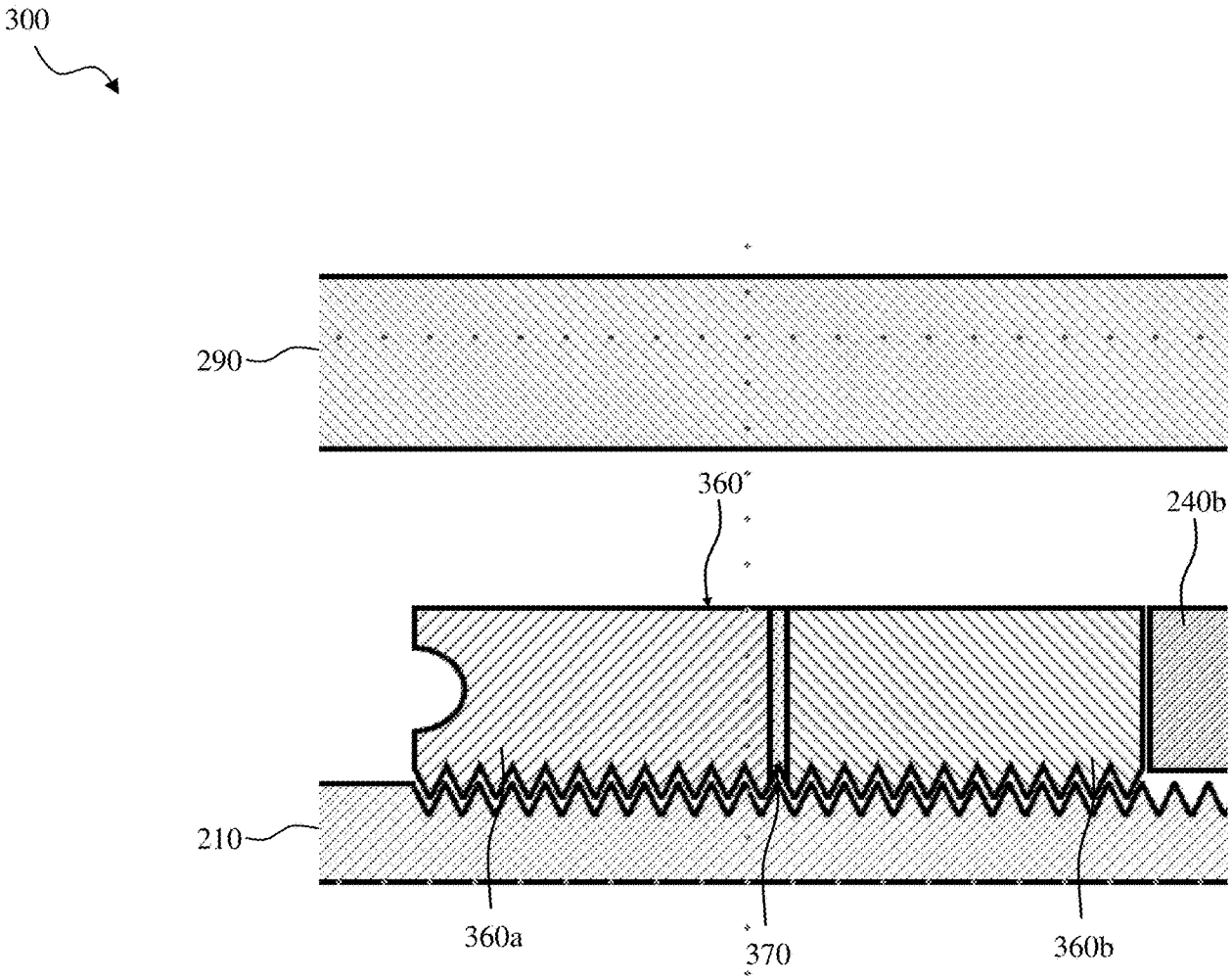
Figure 3C:
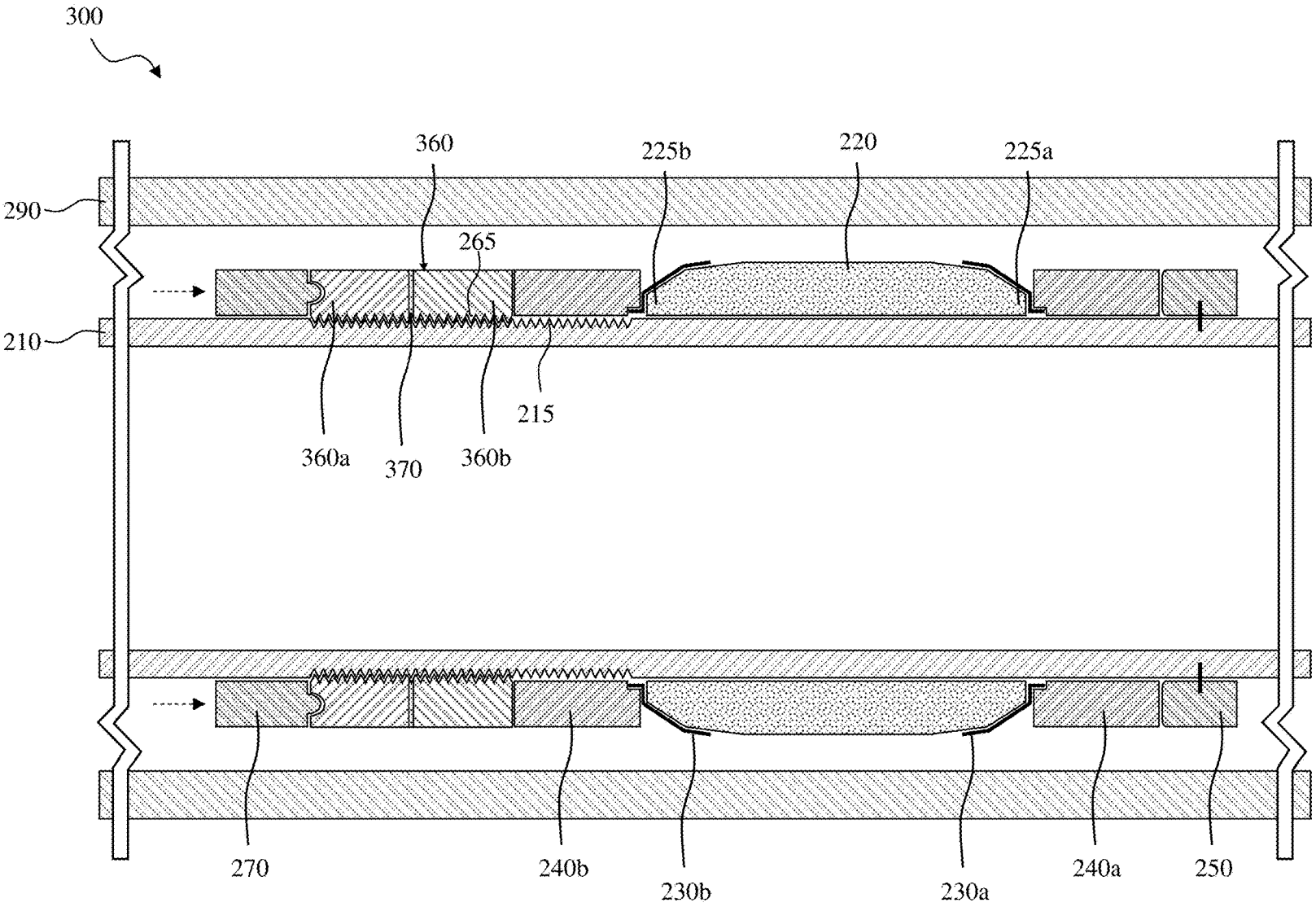
Figure 3D:
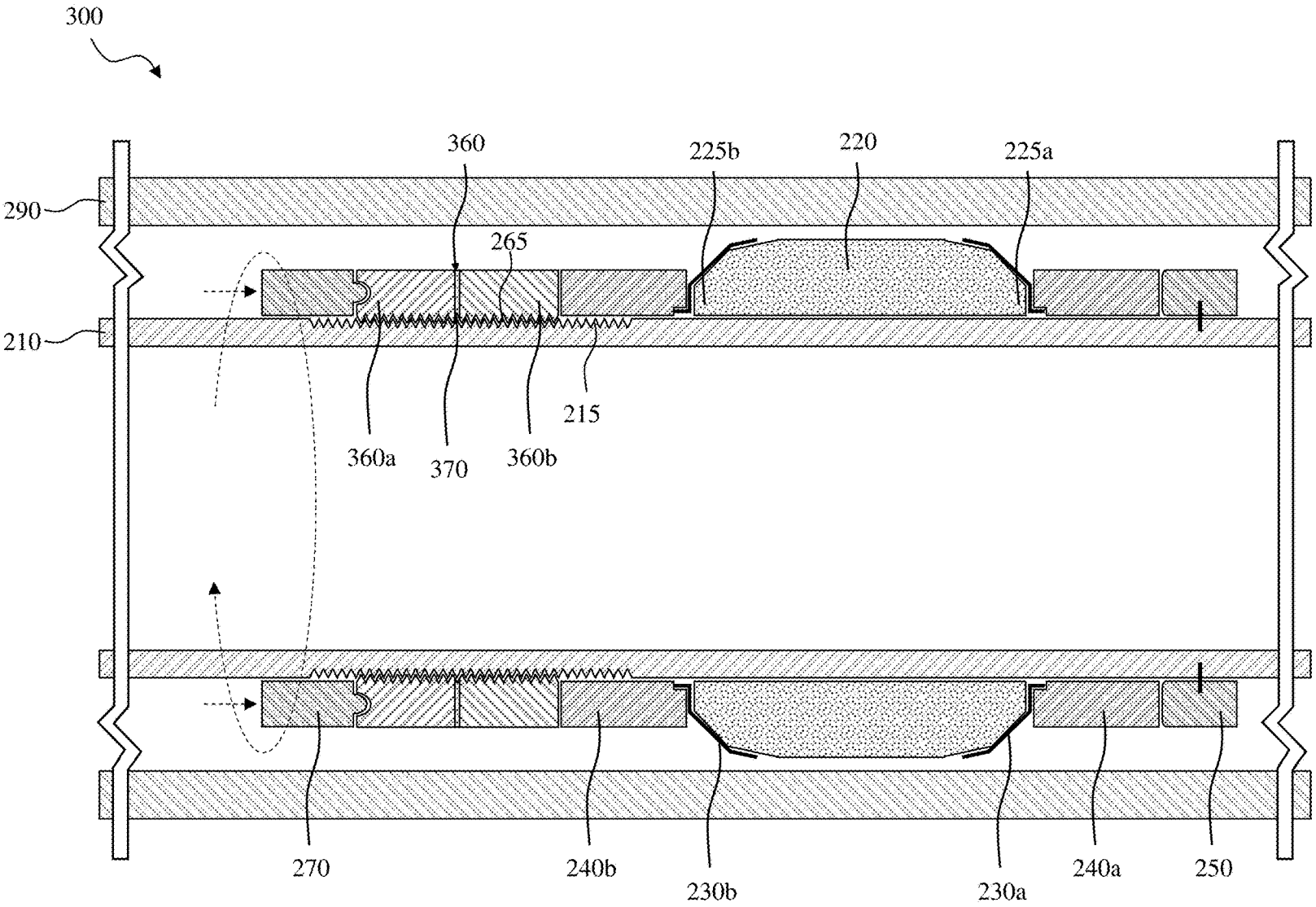
Figure 3E:
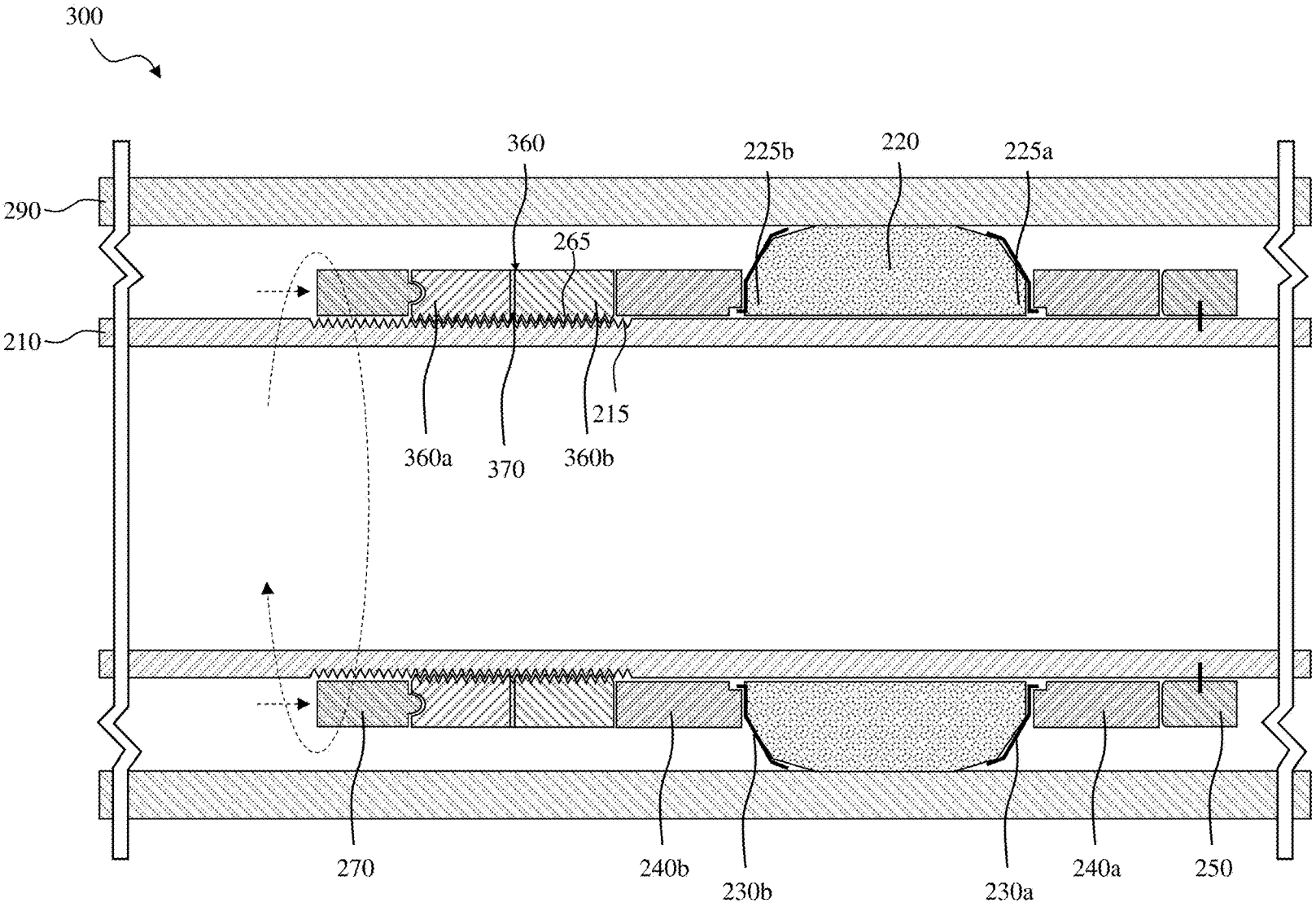
Figure 3F:
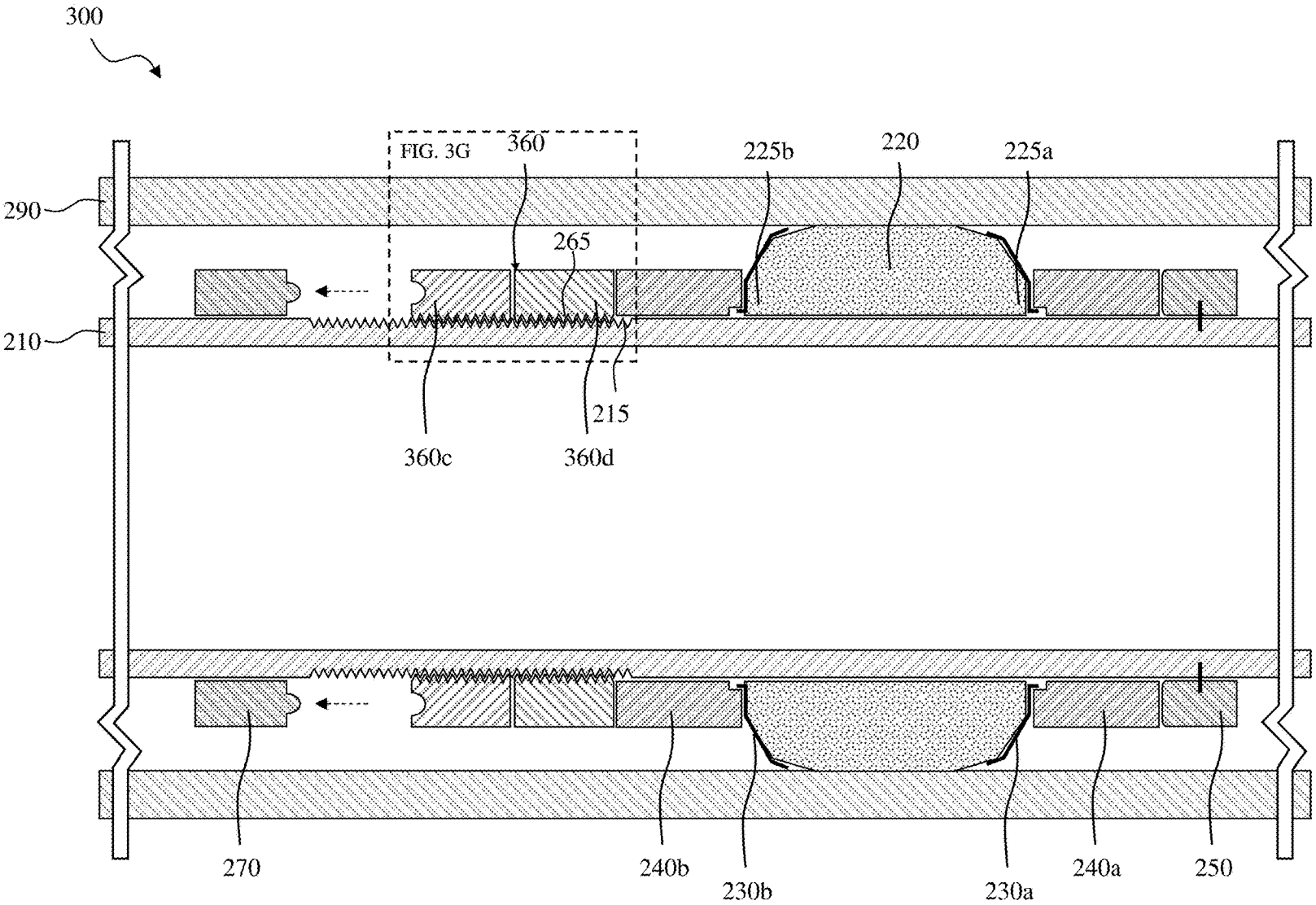

Turning to FIGS. 3A through 3G, depicted are various deployment states for a scaling/anchoring assembly 300 designed, manufactured, and operated according to an alternative embodiment of the disclosure. The sealing/anchoring assembly 300 of FIGS. 3A through 3G is similar in many respects to the sealing/anchoring assembly 200 of FIGS. 2A through 2G. Accordingly, like reference numbers have been used to illustrate similar, if not identical, features. The sealing/anchoring assembly 300 differs, for the most part, from the scaling/anchoring assembly 200, in that the sealing/anchoring assembly 300 employs a different internally threaded setting sleeve 360. In the embodiment of FIGS. 3A through 3G, the internally threaded setting sleeve 360 includes a first setting sleeve portion 360*a* and a second setting sleeve portion 360*b*. Further to the embodiment of FIGS. 3A through 3G, a dissolvable material 370 is positioned between the first setting sleeve portion 360*a* and the second setting sleeve portion 360*b*. In accordance with this embodiment, the dissolvable material 370 is configured to remain intact until the sealing/anchoring element 220 is in its fully radially expanded state (e.g., as shown in FIGS. 3E and 3F), and thereafter dissolve leaving independent locking first and second setting sleeve portions 360*c*, 360*d*. At this stage, the independent locking first and second setting sleeve portions 360*c*, 360*d* are no longer rotationally coupled. Most of the sealing/anchoring element 220 setting load will be resisted by the second setting sleeve portion 360*d* and backed up by the first setting sleeve portion 360*c*, for example to resist any possible thread loosening (e.g., that may occur by way of vibration or any other mechanism).

In one or more embodiments, the independent locking first and second setting sleeve portions 360*c*, 360*d* have male/female connections (e.g., each having a female connection) for future retrieval by the reversed rotary motor 270. In this embodiment, the independent locking first and second setting sleeve portions 360*c*, 360*d* would need to be sequentially retrieved.

Figure 3G:
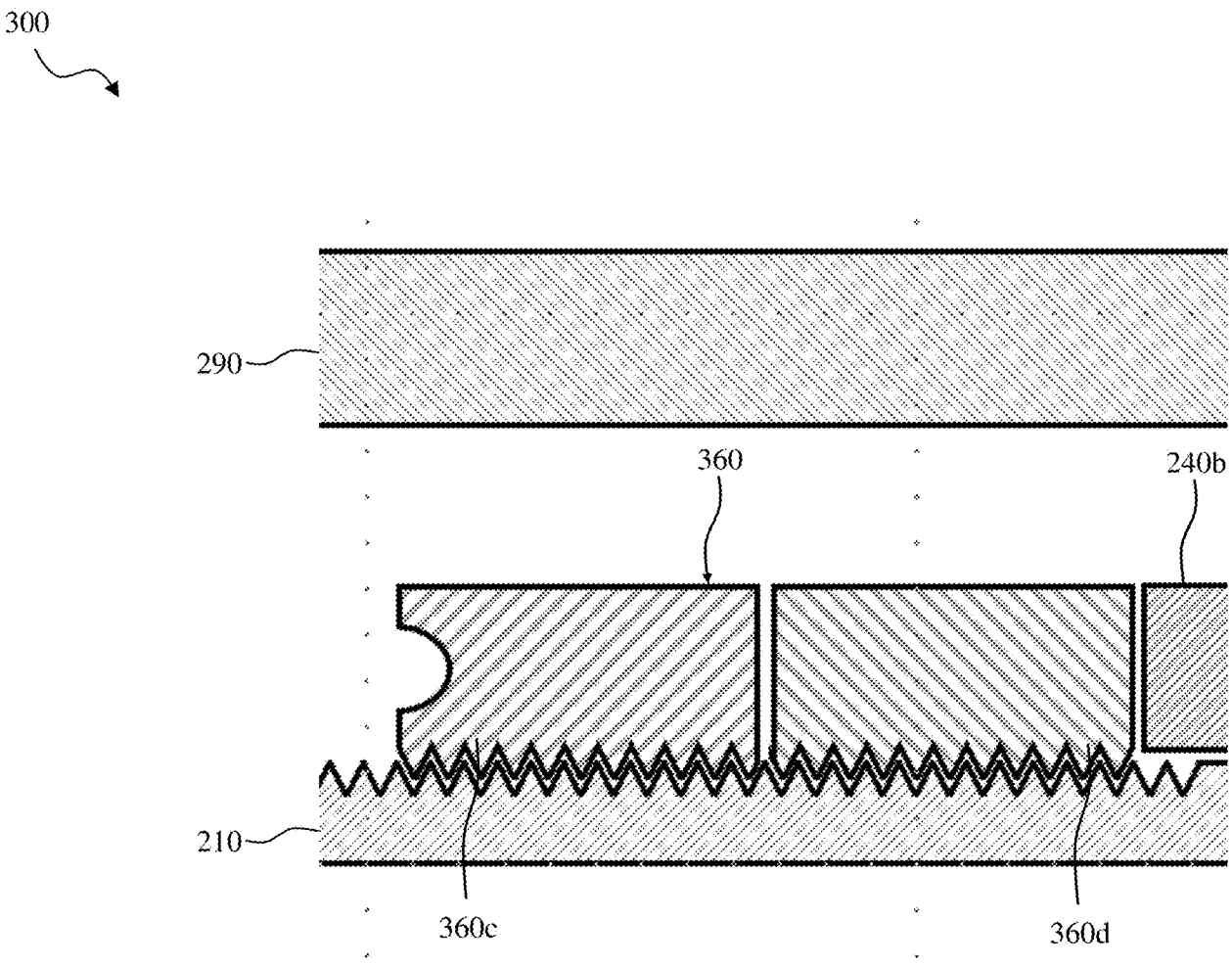

FIG. 3A illustrates the sealing/anchoring assembly 300 in a run-in-hole state, and thus its sealing/anchoring element 220 is in a radially retracted state. FIG. 3B is a zoomed in view of the internally threaded setting sleeve 360 including the first setting sleeve portion 360*a*, the second setting sleeve portion 360*b*, and the dissolvable material 370. FIG. 3C illustrates the scaling/anchoring assembly 300 as the rotary motor 270 has engaged the internally threaded setting sleeve 360. FIG. 3D illustrates the sealing/anchoring assembly 300 after the rotary motor 270 begins to rotate and axially translate the internally threaded setting sleeve 360. FIG. 3E illustrates the sealing/anchoring assembly 300 after the sealing/anchoring element 220 is in its fully radially expanded state. FIG. 3F illustrates the sealing/anchoring assembly 300 after the rotary motor 270 has disengaged from the internally threaded setting sleeve 360. FIG. 3G is a zoomed in view of the internally threaded setting sleeve 360 including the independent locking first and second setting sleeve portions 360*c*, 360*d*.

Figure 4A:
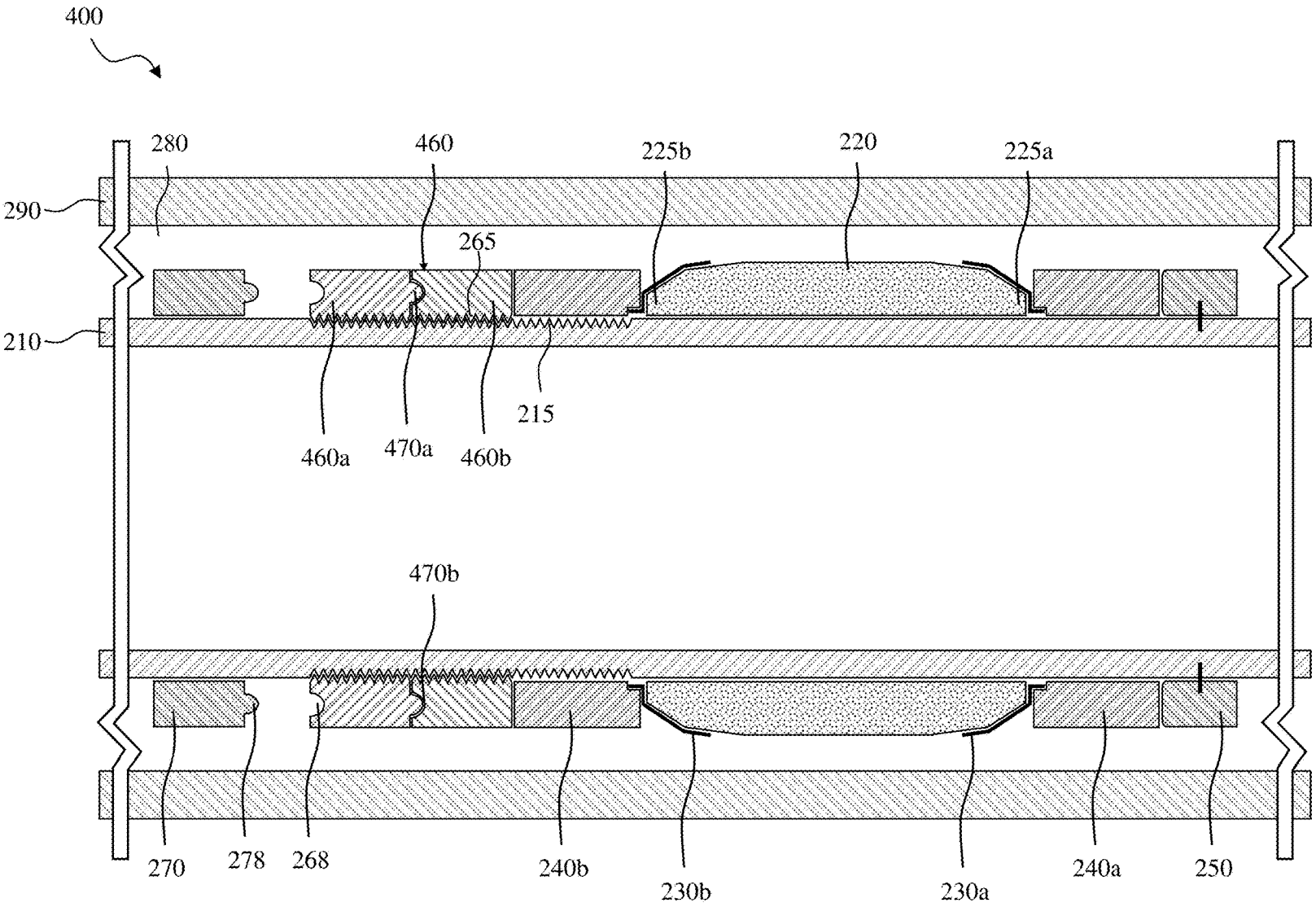
Figure 4B:
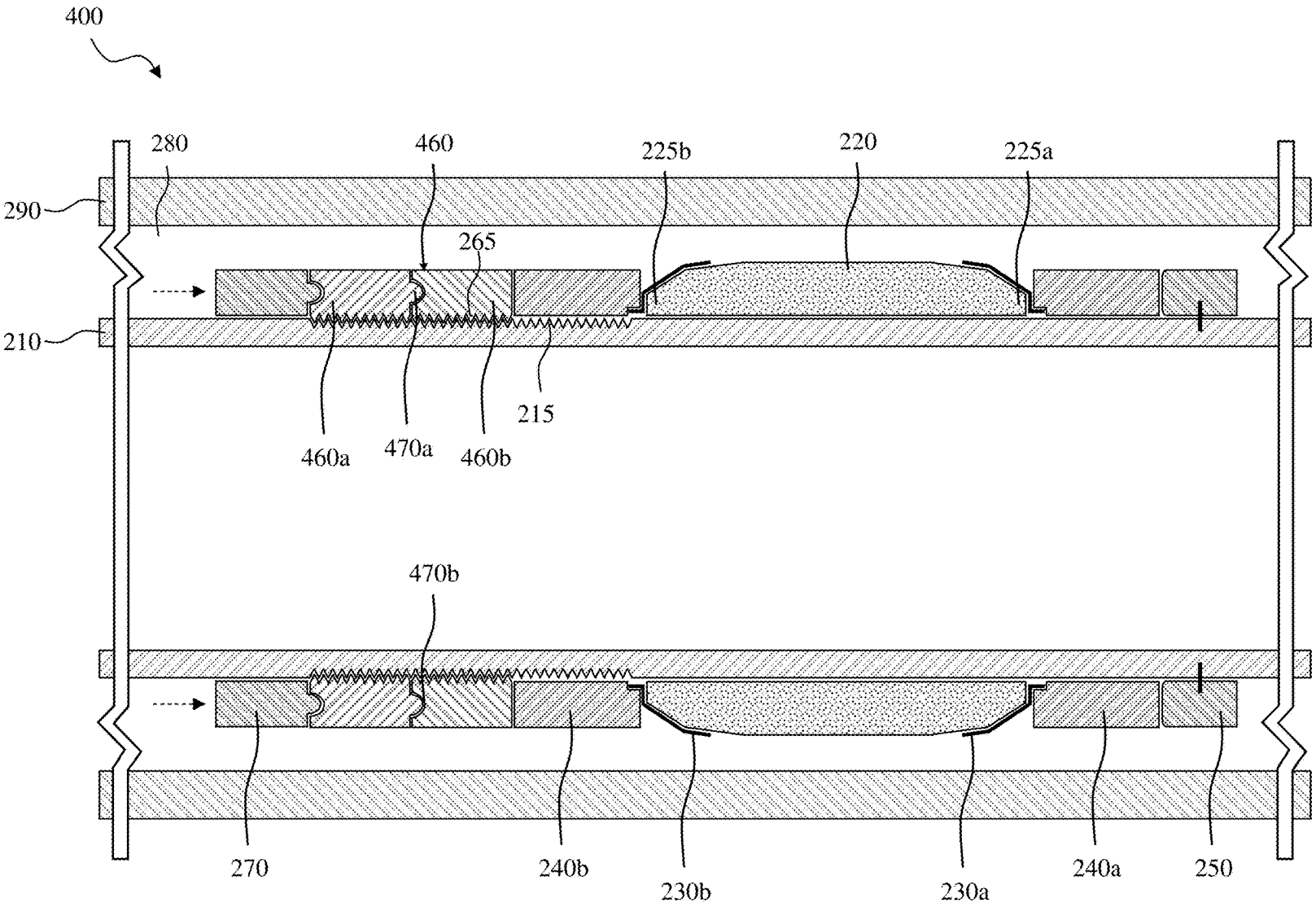
Figure 4C:
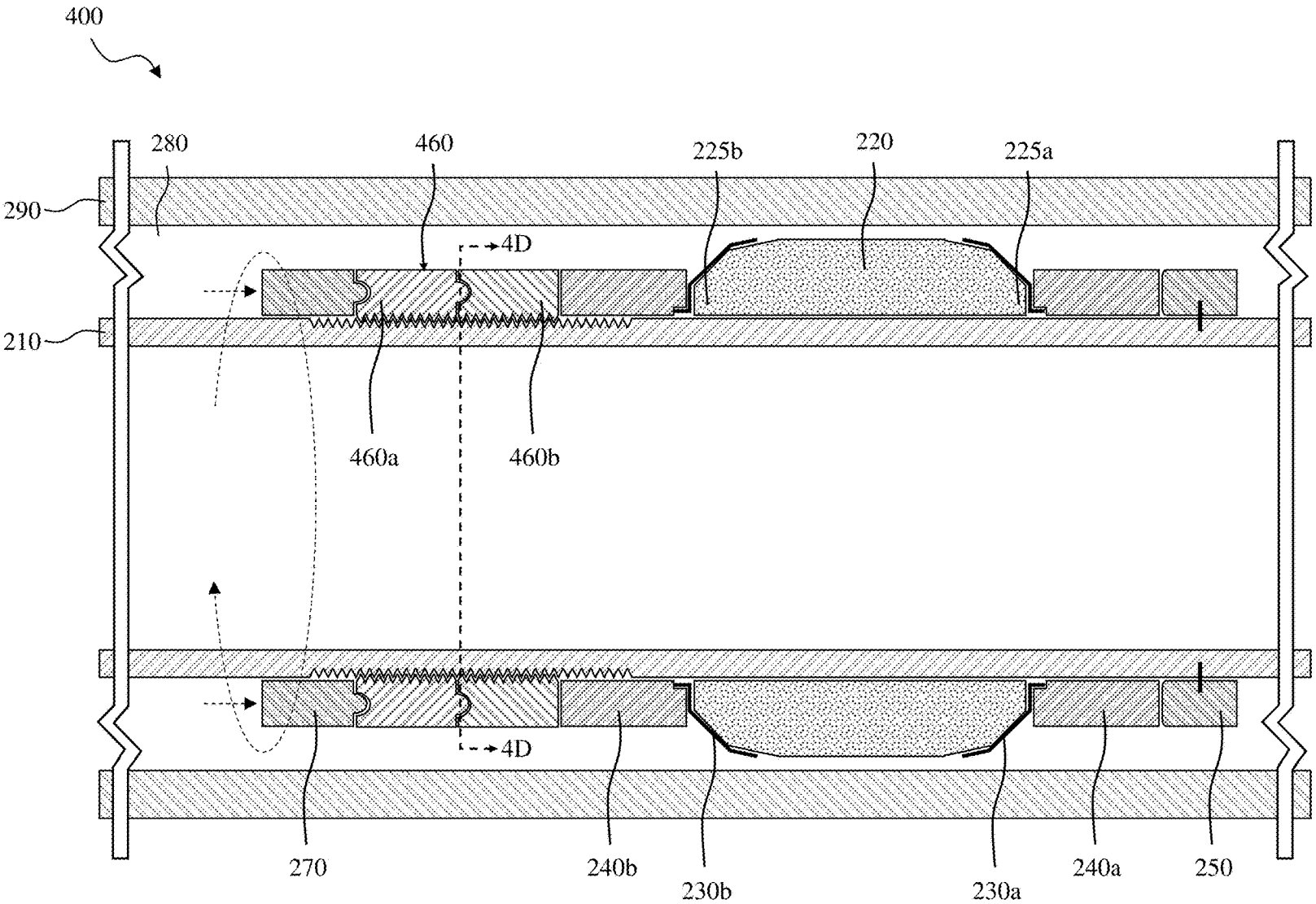
Figure 4D:
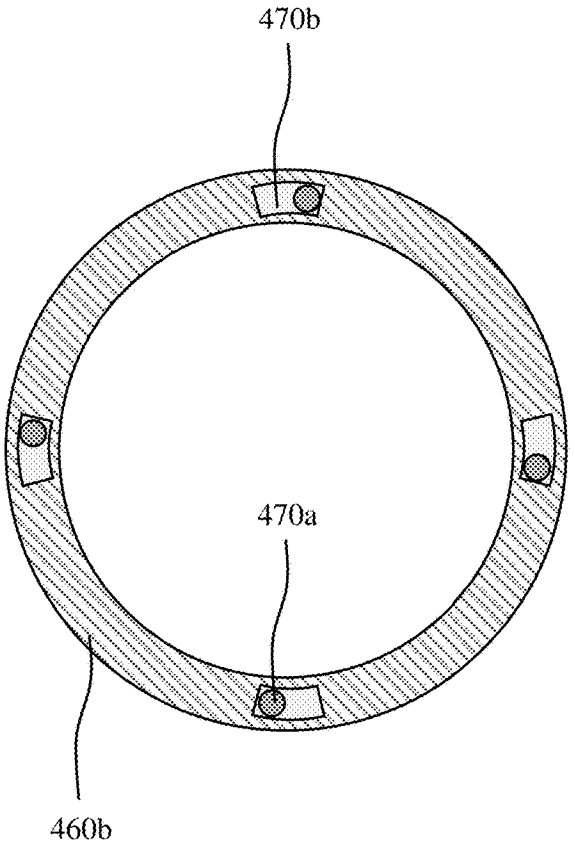
Figure 4E:
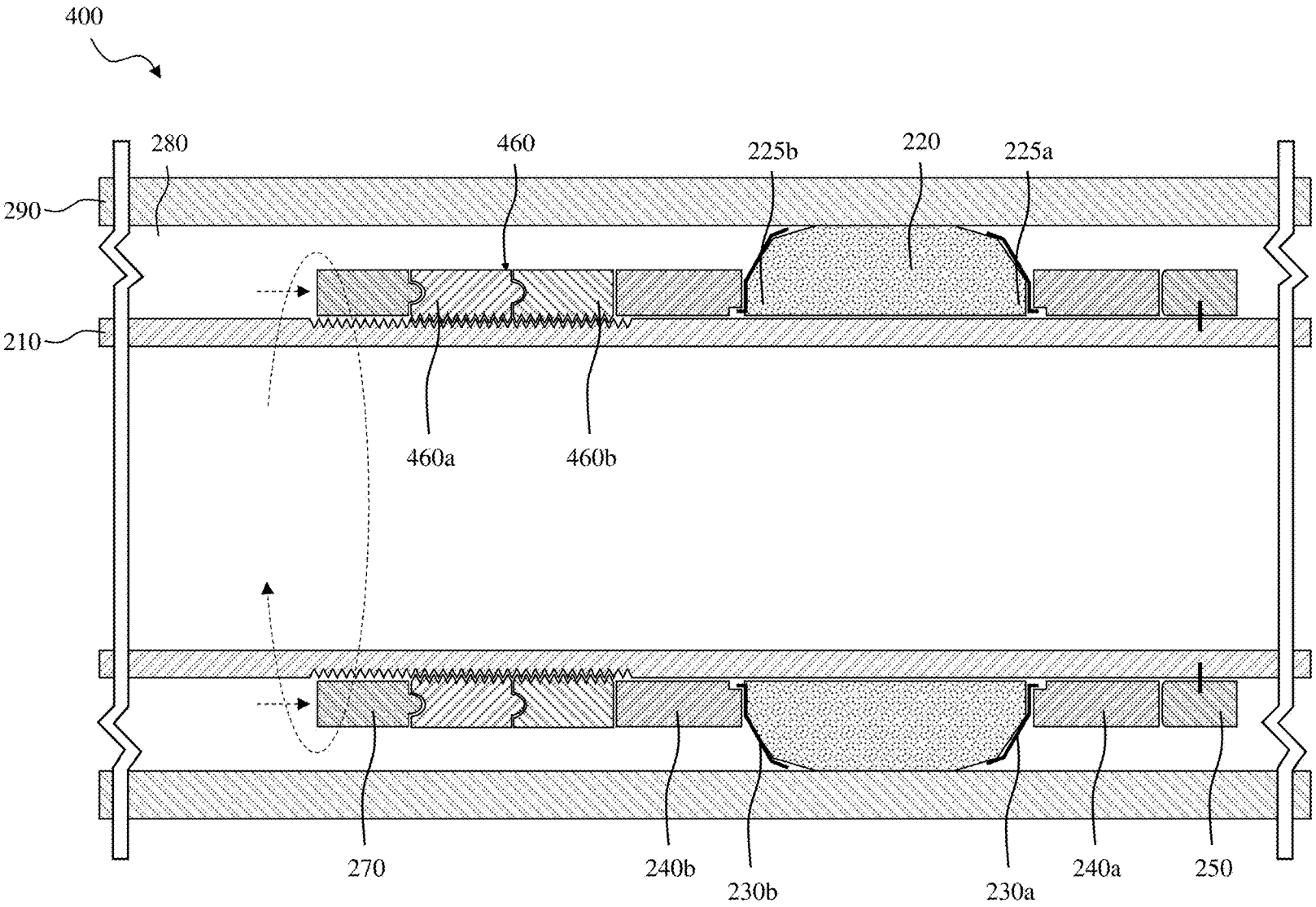
Figure 4F:
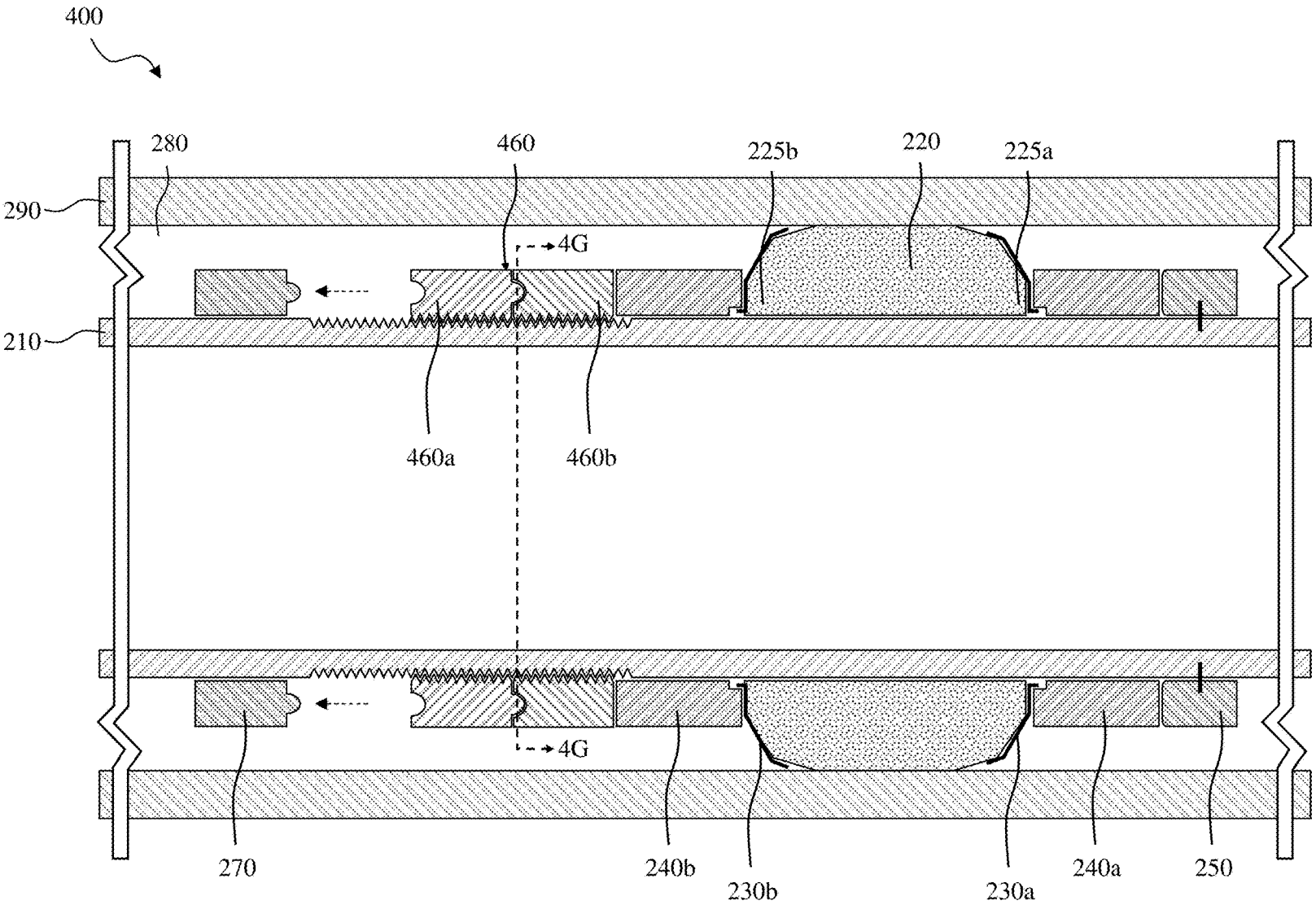
Figure 4G:
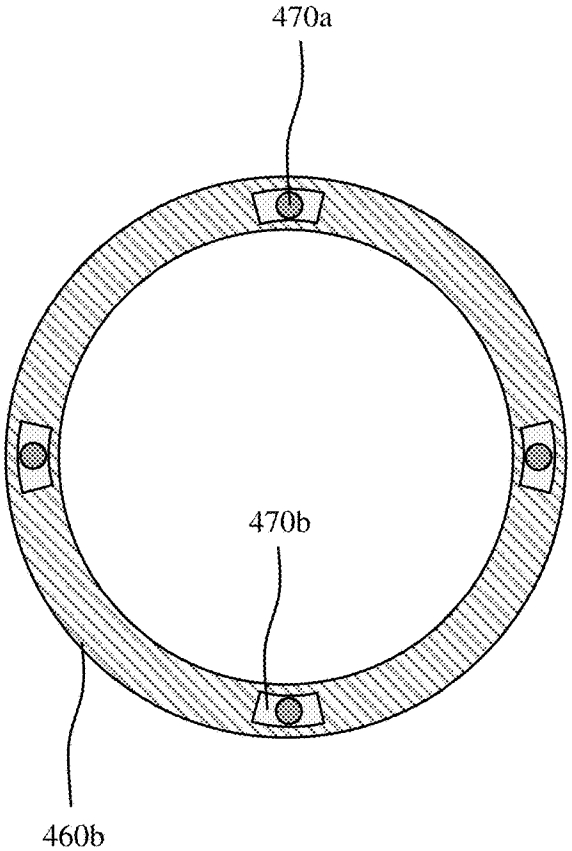

Turning to FIGS. 4A through 4G, depicted are various deployment states for a scaling/anchoring assembly 400 designed, manufactured and operated according to an alternative embodiment of the disclosure. The sealing/anchoring assembly 400 of FIGS. 4A through 4G is similar in many respects to the sealing/anchoring assembly 300 of FIGS. 3A through 3G. Accordingly, like reference numbers have been used to illustrate similar, if not identical, features. The sealing/anchoring assembly 400 differs, for the most part, from the scaling/anchoring assembly 300, in that the sealing/anchoring assembly 400 employs a different internally threaded setting sleeve 460. In the embodiment of FIGS. 4A through 4G, the first setting sleeve portion 460*a* has one of a male member 470*a* or female member 470*b*, and the second setting sleeve portion 460*b* has the other of the female member 470*b* or the male member 470*a*. In this embodiment, the male and female member 470*a*, 470*b* are configured to rotationally fix the first setting sleeve portion 460*a* and the second setting sleeve portion 460*b* as the sealing/anchoring element 220 is moving from the radially retracted state to the radially expanded state, but allow the second setting sleeve portion 460*b* to be at least partially rotationally free from the first setting sleeve portion 460*a* once the sealing/anchoring element 220 is in its fully radially expanded state, thereby leaving independent locking first and second setting sleeve portions. For example, in at least one embodiment the female member 470*b* is an arced slot that is larger than the male member 470*a* (e.g., as shown in FIGS. 4D and 4G), which allows for the foregoing.

In at least one embodiment, once the sealing/anchoring element 220 is set and before retrieving the rotary motor 270, a small un-twisting may be applied to the first setting sleeve portion 460*a* releasing the rotational constraint between the first and second setting sleeve portions 460*a*, 460*b*. In at least one embodiment, the axial constraint may still be maintained through an optional compressible disk or washer (not shown) located between the first and second setting sleeve portions 460*a*, 460*b*. Therefore, any potential loosening of the second setting sleeve portion 460*b* is resisted by the first setting sleeve portion 460*a*. For retrieval, the rotary motor 270 may un-torque the first setting sleeve portion 460*a*, which will automatically un-torque and release the second setting sleeve portion 460*b*, and ultimately the scaling/anchoring element 220 subsequently.

FIG. 4A illustrates the sealing/anchoring assembly 400 in a run-in-hole state, and thus its sealing/anchoring element 220 is in a radially retracted state. FIG. 4B illustrates the scaling/anchoring assembly 400 as the rotary motor 270 has engaged the internally threaded setting sleeve 460. FIG. 4C illustrates the sealing/anchoring assembly 400 after the rotary motor 270 begins to rotate and axially translate the internally threaded setting sleeve 460. FIG. 4D illustrates a cross-sectional view of an interaction between the first and second setting sleeve portions 460*a*, 460*b* of FIG. 4C. FIG. 4E illustrates the sealing/anchoring assembly 400 after the scaling/anchoring element 220 is in its fully radially expanded state. FIG. 4F illustrates the scaling/anchoring assembly 400 after the rotary motor 270 has disengaged from the internally threaded setting sleeve 460. FIG. 4G illustrates a cross-sectional view of an interaction between the first and second setting sleeve portions 460*a*, 460*b* of FIG. 4F.

Turning to FIGS. 5A through 5E, depicted are various deployment states for a scaling/anchoring assembly 500 designed, manufactured and operated according to an alternative embodiment of the disclosure. The sealing/anchoring assembly 500 of FIGS. 5A through 5E is similar in many respects to the sealing/anchoring assembly 300 of FIGS. 3A through 3G. Accordingly, like reference numbers have been used to illustrate similar, if not identical, features. The sealing/anchoring assembly 500 differs, for the most part, from the scaling/anchoring assembly 300, in that the sealing/anchoring assembly 500 employs a different internally threaded setting sleeve 560. In the embodiment of FIGS. 5A through 5E, the first setting sleeve portion 560*a* and the second setting sleeve portion 560*b* include one or more axially aligned passageways 570*a*. 570*b* therethrough. In this embodiment, the one or more axially aligned passageways 570*a*, 570*b* are configured to receive one or more related post members 575 from a rotary motor 570 coupled thereto. Accordingly, the first and second setting sleeve portions 560*a*, 560*b* are rotationally fixed relative to one another when the one or more related post members 575 are within the one or more axially aligned passageways 570*a*, 570*b*, but are independent locking first and second setting sleeve portions free to rotate relative to one another when the one or more related post members 575 are not within the one or more axially aligned passageways 570*a*, 570*b*.

In at least one embodiment, there is no mechanical connection between the first setting sleeve portion 560*a* and the second setting sleeve portion 560*b*, but the one or more related post members 575 penetrate the one or more axially aligned passageways 570*a*, 570*b*, and thus rotate the first setting sleeve portion 560*a* and the second setting sleeve portion 560*b* at the same time. Retrieval of the sealing/anchoring assembly 500 is reverse of the setting process, where the first setting sleeve portion 560*a* and the second setting sleeve portion 560*b* will be un-torqued by the rotary motor 570 having the one or more related post members 575.

Figure 5A:
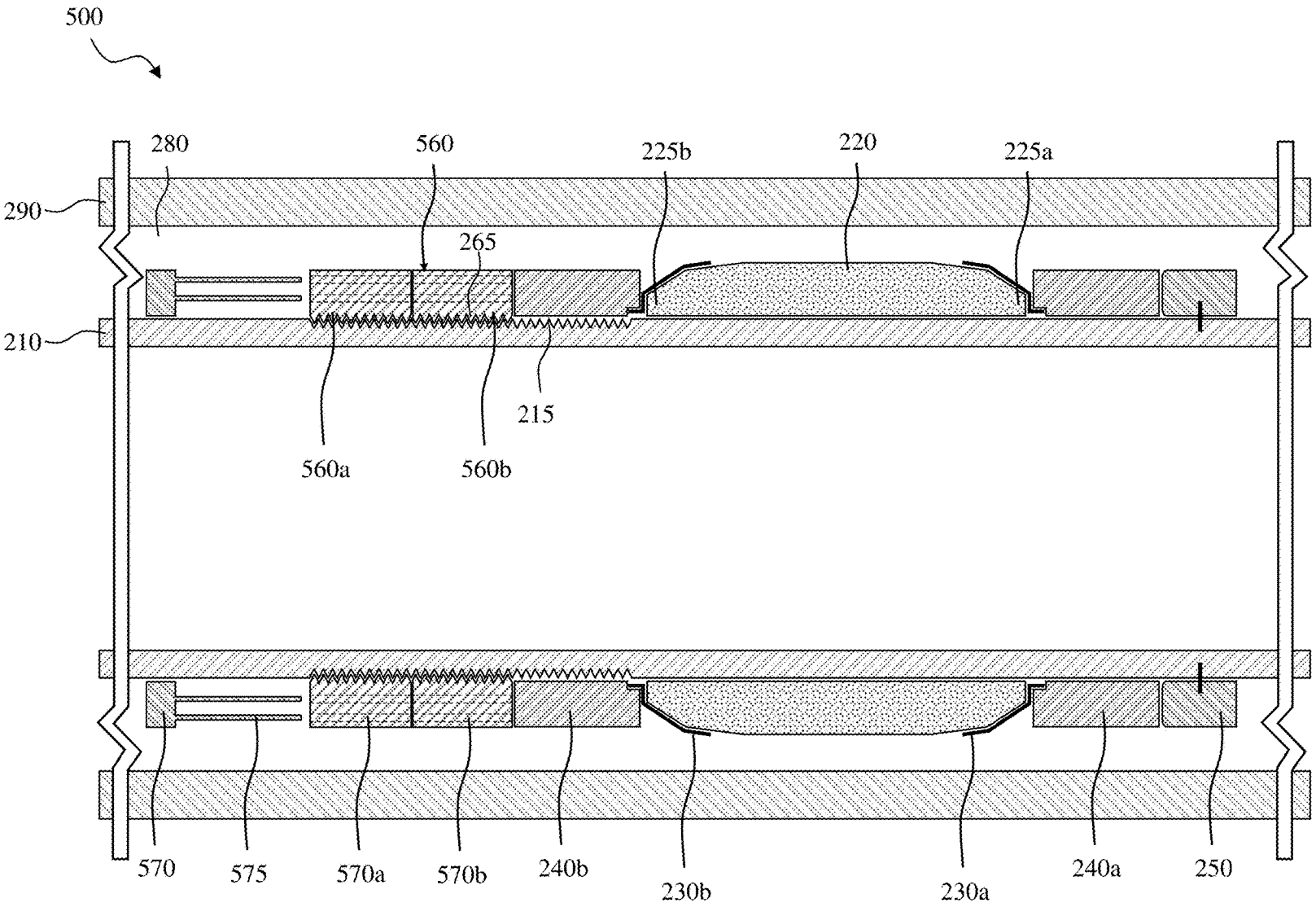
Figure 5B:
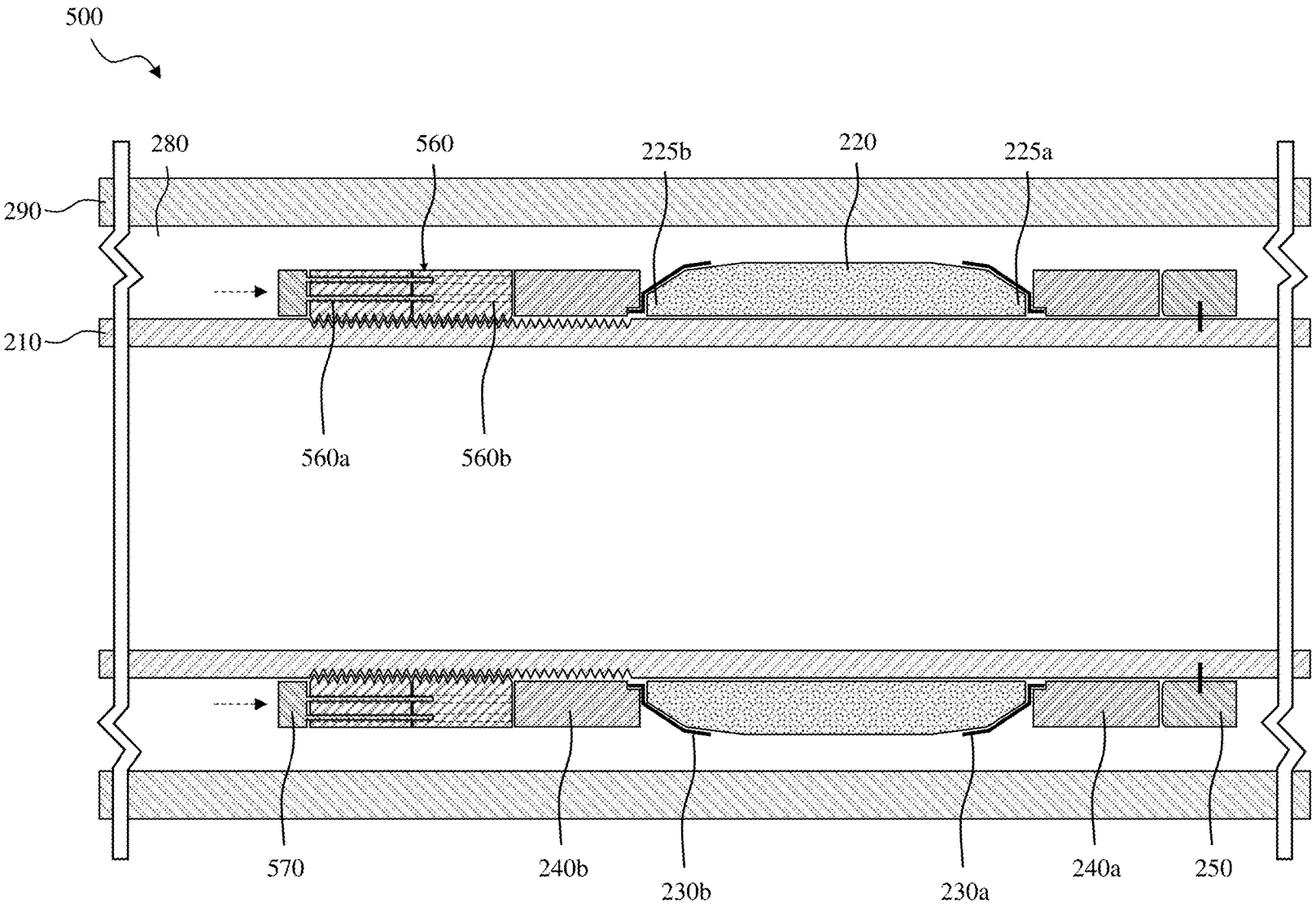
Figure 5C:
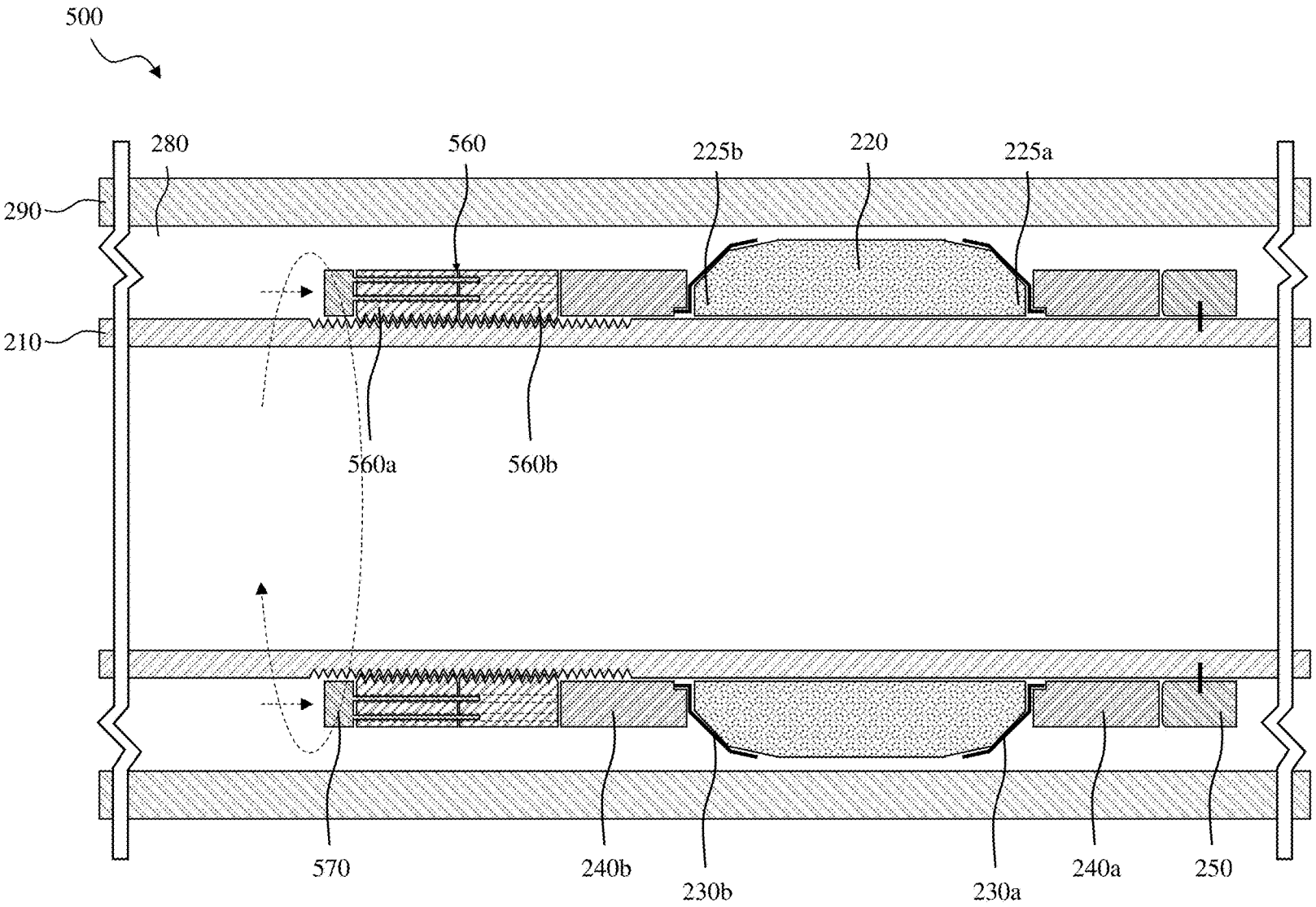
Figure 5D:
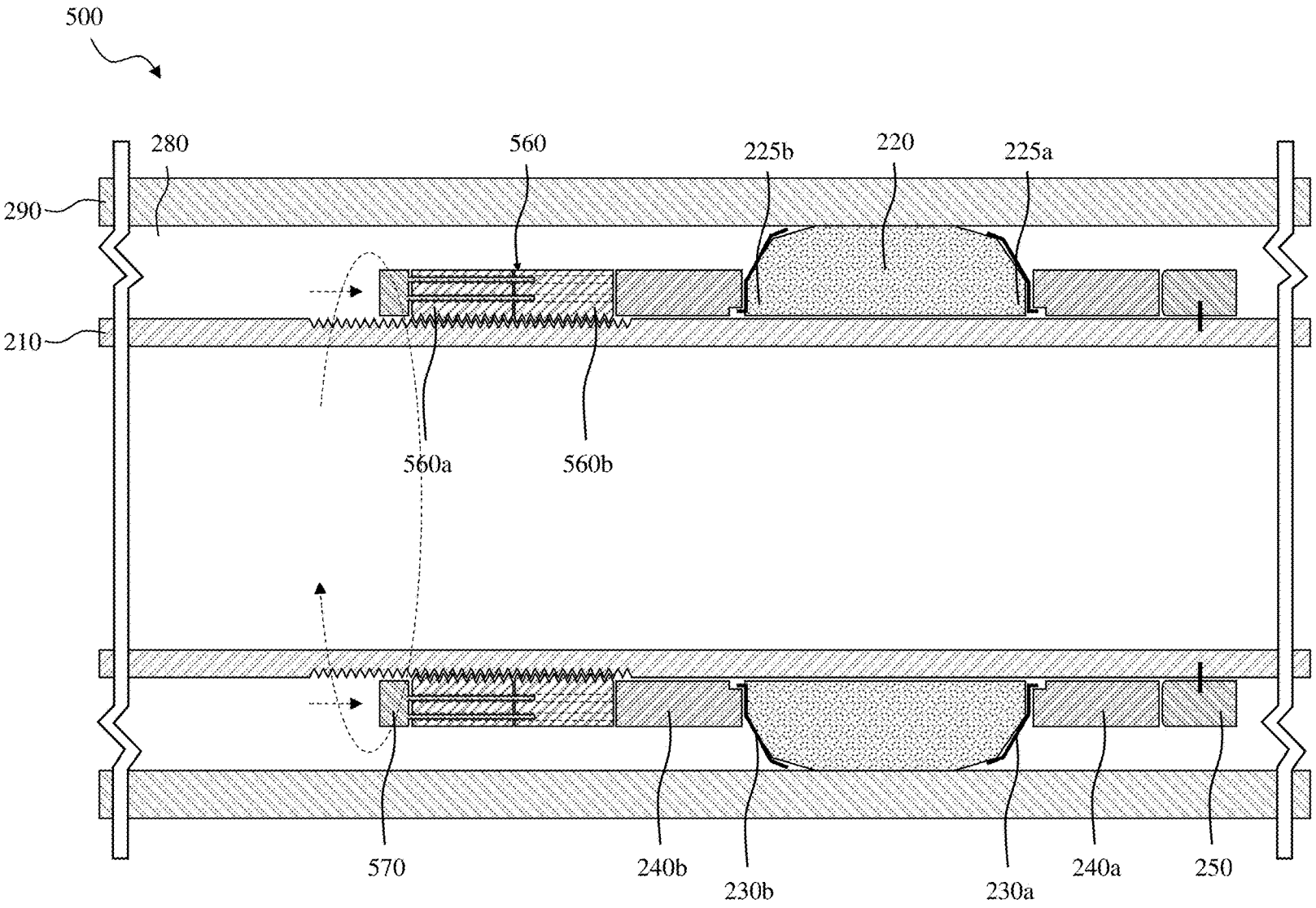
Figure 5E:
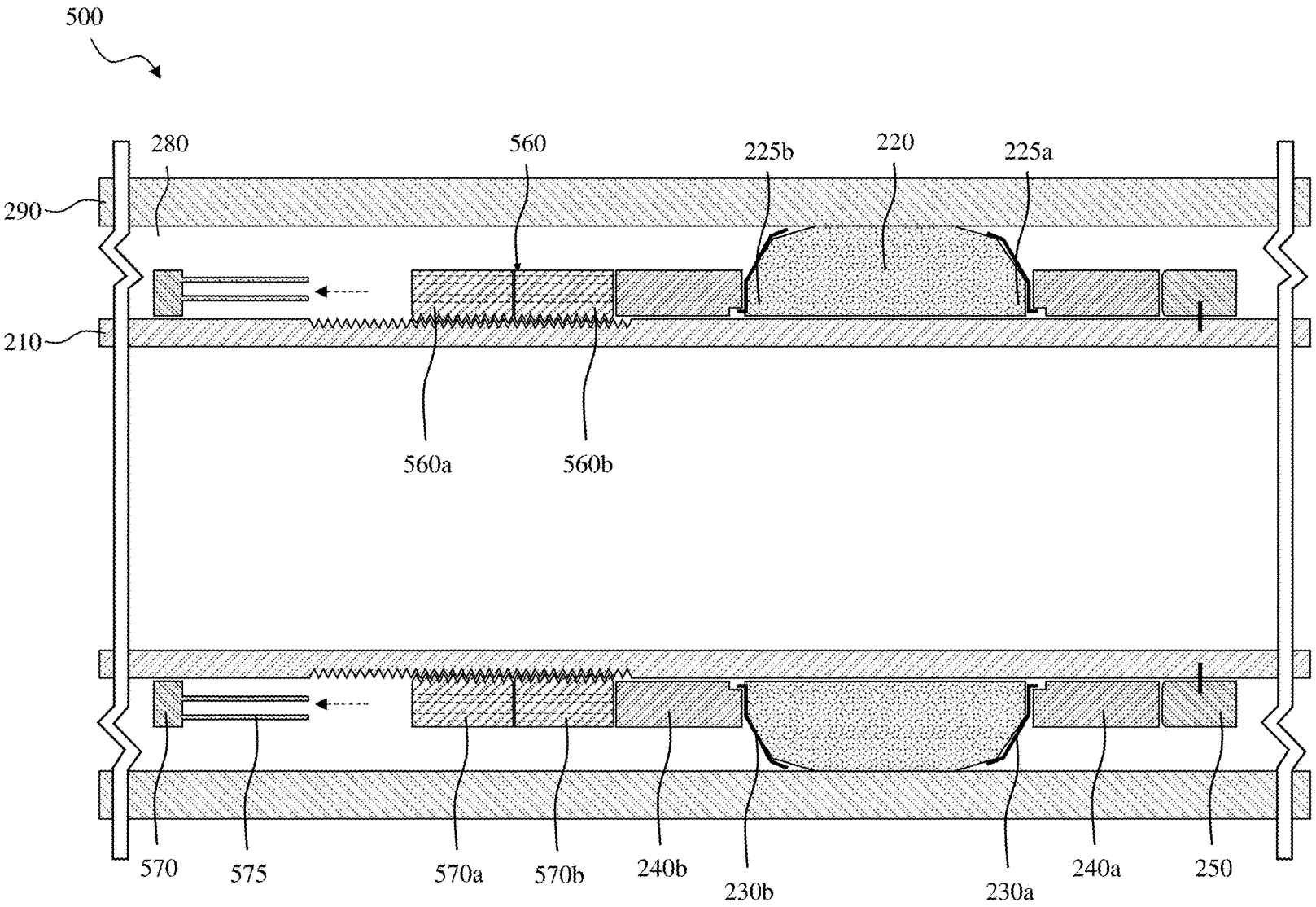

FIG. 5A illustrates the sealing/anchoring assembly 500 in a run-in-hole state, and thus its scaling/anchoring element 220 is in a radially retracted state. FIG. 5B illustrates the scaling/anchoring assembly 500 as the rotary motor 570 has engaged the internally threaded setting sleeve 560. FIG. 5C illustrates the sealing/anchoring assembly 500 after the rotary motor 570 begins to rotate and axially translate the internally threaded setting sleeve 560. FIG. 5D illustrates the scaling/anchoring assembly 500 after the sealing/anchoring element 220 is in its fully radially expanded state. FIG. 5E illustrates the sealing/anchoring assembly 500 after the rotary motor 570 has disengaged from the internally threaded setting sleeve 560.

Aspects disclosed herein include:

A. An anchoring/scaling assembly, the anchoring/sealing assembly including: 1) a mandrel; 2) a sealing/anchoring element positioned about the mandrel; 3) a setting sleeve coupled with a first end of the sealing/anchoring element; and 4) an internally threaded setting sleeve coupled with a second end of the sealing/anchoring element, the internally threaded setting sleeve configured to employ its internal threads to rotate and axially translate along the mandrel to move the sealing/anchoring element between a radially retracted state a radially expanded state B. A well system, the well system including: 1) a wellbore located in a subterranean formation; and 2) a sealing/anchoring assembly positioned in the wellbore, the sealing/anchoring assembly including: a) a mandrel; b) a scaling/anchoring element positioned about the mandrel; c) a setting sleeve coupled with a first end of the sealing/anchoring element; and d) an internally threaded setting sleeve coupled with a second end of the sealing/anchoring element, the internally threaded setting sleeve configured to employ its internal threads to rotate and axially translate along the mandrel to move the sealing/anchoring element between a radially retracted state a radially expanded state.

C. A method, the method including: 1) positioning a sealing/anchoring assembly within a wellbore located in a subterranean formation, the sealing/anchoring assembly including: a) a mandrel; b) a sealing/anchoring element positioned about the mandrel; c) a setting sleeve coupled with a first end of the sealing/anchoring element; and d) an internally threaded setting sleeve coupled with a second end of the sealing/anchoring element, the internally threaded setting sleeve configured to employ its internal threads to rotate and axially translate along the mandrel to move the sealing/anchoring element between a radially retracted state a radially expanded state; 2) coupling a rotary motor with the internally threaded setting sleeve; and 3) actuating the rotary motor to rotate and axially translate the internally threaded setting sleeve to move the sealing/anchoring element from the radially retracted state to the radially expanded state.

Aspects A, B and C may have one or more of the following additional elements in combination: Element 1: wherein the mandrel has external threads to move the sealing/anchoring element between the radially retracted state and the radially expanded state. Element 2: further including a rotary motor coupled to the internally threaded setting sleeve, the rotary motor configured to rotate and axially translate the internally threaded setting sleeve to move the sealing/anchoring element between the radially retracted state and the radially expanded state. Element 3: wherein the rotary motor has one of a male member or female member, and the internally threaded setting sleeve has an other of the female member or the male member, the male and female members configured to rotationally fix the rotary motor with the internally threaded setting sleeve. Element 4: wherein the rotary motor has one or more male members on a downhole face thereof and the internally threaded setting sleeve has one or more female members on an uphole face thereof, the one or more male members of the rotary motor configured to engage with the one or more female members of the internally threaded setting sleeve to rotationally fix the rotary motor with the internally threaded setting sleeve. Element 5: wherein the internally threaded setting sleeve includes a first setting sleeve portion and a second setting sleeve portion. Element 6: further including a dissolvable material positioned between the first setting sleeve portion and the second setting sleeve portion, the dissolvable material configured to remain intact until the sealing/anchoring element is in its fully radially expanded state and thereafter dissolve leaving independent locking first and second setting sleeve portions. Element 7: wherein the first setting sleeve portion has one of a male member or female member, and the second setting sleeve portion has an other of the female member or the male member, the male and female members configured to rotationally fix the first setting sleeve portion and the second setting sleeve portion as the sealing/anchoring element is moving from the radially retracted state to the radially expanded state but allow the second setting sleeve portion to be at least partially rotationally free from the first setting sleeve portion once the scaling/anchoring element is in its fully radially expanded state, thereby leaving independent locking first and second setting sleeve portions. Element 8: wherein the first setting sleeve portion and the second setting sleeve portion include one or more axially aligned passageways therethrough, the one or more axially aligned passageways configured to receive one or more related post members from a rotary motor coupled thereto, such that the first and second setting sleeve portions are rotationally fixed relative to one another when the one or more related post members are within the one or more axially aligned passageways but are independent locking first and second setting sleeve portions free to rotate relative to one another when the one or more related post members are not within the one or more axially aligned passageways. Element 9: further including a first collar sleeve disposed between the first end of the sealing/anchoring element and the setting sleeve and a second collar sleeve disposed between the second end of the sealing/anchoring element and the internally threaded setting sleeve. Element 10: further including a first backup shoe disposed between the first end of the sealing/anchoring element and the first collar sleeve and a second backup shoe disposed between the second end of the sealing/anchoring element and the second collar sleeve. Element 11: wherein the setting sleeve is an axially fixed setting sleeve. Element 12: wherein the wellbore is a main wellbore, and further including a lateral wellbore extending from the main wellbore, the sealing/anchoring assembly positioned proximate an intersection between the main wellbore and the lateral wellbore.

Those skilled in the art to which this application relates will appreciate that other and further additions, deletions, substitutions and modifications may be made to the described embodiments.

What is claimed is:

1. A sealing/anchoring assembly, comprising:

a mandrel;

a sealing/anchoring element positioned about the mandrel;

a setting sleeve coupled with a first end of the sealing/anchoring element; and an internally threaded setting sleeve coupled with a second end of the sealing/anchoring element, the internally threaded setting sleeve configured to employ its internal threads to rotate and axially translate along the mandrel to move the sealing/anchoring element between a radially retracted state a radially expanded state, wherein the internally threaded setting sleeve includes a first setting sleeve portion and a second setting sleeve portion, and further including a dissolvable material positioned between the first setting sleeve portion and the second setting sleeve portion, the dissolvable material configured to remain intact until the sealing/anchoring element is in its fully radially expanded state and thereafter dissolve leaving independent locking first and second setting sleeve portions.

2. The sealing/anchoring assembly as recited in claim 1, wherein the mandrel has external threads, the internal threads of the internally threaded setting sleeve configured to engage with the external threads to move the sealing/anchoring element between the radially retracted state and the radially expanded state.

3. The sealing/anchoring assembly as recited in claim 1, further including a first collar sleeve disposed between the first end of the sealing/anchoring element and the setting sleeve and a second collar sleeve disposed between the second end of the sealing/anchoring element and the internally threaded setting sleeve.

4. The sealing/anchoring assembly as recited in claim 3, further including a first backup shoe disposed between the first end of the sealing/anchoring element and the first collar sleeve and a second backup shoe disposed between the second end of the sealing/anchoring element and the second collar sleeve.

5. The sealing/anchoring assembly as recited in claim 3, wherein the setting sleeve is an axially fixed setting sleeve.

6. The sealing/anchoring assembly as recited in claim 1, further including a rotary motor coupled to the internally threaded setting sleeve, the rotary motor configured to rotate and axially translate the internally threaded setting sleeve to move the sealing/anchoring element between the radially retracted state and the radially expanded state.

7. The sealing/anchoring assembly as recited in claim 6, wherein the rotary motor has one of a male member or female member, and the internally threaded setting sleeve has an other of the female member or the male member, the male and female members configured to rotationally fix the rotary motor with the internally threaded setting sleeve.

8. The sealing/anchoring assembly as recited in claim 7, wherein the rotary motor has one or more male members on a downhole face thereof and the internally threaded setting sleeve has one or more female members on an uphole face thereof, the one or more male members of the rotary motor configured to engage with the one or more female members of the internally threaded setting sleeve to rotationally fix the rotary motor with the internally threaded setting sleeve.

9. A well system, comprising:

a wellbore located in a subterranean formation; and a sealing/anchoring assembly positioned in the wellbore, the sealing/anchoring assembly including:

a mandrel;

a sealing/anchoring element positioned about the mandrel;

a setting sleeve coupled with a first end of the sealing/anchoring element;

an internally threaded setting sleeve coupled with a second end of the sealing/anchoring element, the internally threaded setting sleeve configured to employ its internal threads to rotate and axially translate along the mandrel to move the sealing/anchoring element between a radially retracted state a radially expanded state, wherein the internally threaded setting sleeve includes a first setting sleeve portion and a second setting sleeve portion, and further including a dissolvable material positioned between the first setting sleeve portion and the second setting sleeve portion, the dissolvable material configured to remain intact until the sealing/anchoring element is in its fully radially expanded state and thereafter dissolve leaving independent locking first and second setting sleeve portions.

10. The well system as recited in claim 9, wherein the wellbore is a main wellbore, and further including a lateral wellbore extending from the main wellbore, the sealing/anchoring assembly positioned proximate an intersection between the main wellbore and the lateral wellbore.

11. The well system as recited in claim 9, wherein the mandrel has external threads, the internal threads of the internally threaded setting sleeve configured to engage with the external threads to move the sealing/anchoring element between the radially retracted state and the radially expanded state.

12. The well system as recited in claim 9, further including a first collar sleeve disposed between the first end of the sealing/anchoring element and the setting sleeve and a second collar sleeve disposed between the second end of the sealing/anchoring element and the internally threaded setting sleeve.

13. The well system as recited in claim 12, further including a first backup shoe disposed between the first end of the sealing/anchoring element and the first collar sleeve and a second backup shoe disposed between the second end of the sealing/anchoring element and the second collar sleeve.

14. The well system as recited in claim 12, wherein the setting sleeve is an axially fixed setting sleeve.

15. The well system as recited in claim 9, further including a rotary motor coupled to the internally threaded setting sleeve, the rotary motor configured to rotate and axially translate the internally threaded setting sleeve to move the sealing/anchoring element between the radially retracted state and the radially expanded state.

16. The well system as recited in claim 15, wherein the rotary motor has one of a male member or female member, and the internally threaded setting sleeve has an other of the female member or the male member, the male and female members configured to rotationally fix the rotary motor with the internally threaded setting sleeve.

17. The well system as recited in claim 16, wherein the rotary motor has one or more male members on a downhole face thereof and the internally threaded setting sleeve has one or more female members on an uphole face thereof, the one or more male members of the rotary motor configured to engage with the one or more female members of the internally threaded setting sleeve to rotationally fix the rotary motor with the internally threaded setting sleeve.

18. A method, comprising:

positioning a sealing/anchoring assembly within a wellbore located in a subterranean formation, the sealing/anchoring assembly including:

a mandrel;

a sealing/anchoring element positioned about the mandrel;

a setting sleeve coupled with a first end of the sealing/anchoring element; and an internally threaded setting sleeve coupled with a second end of the sealing/anchoring element, the internally threaded setting sleeve configured to employ its internal threads to rotate and axially translate along the mandrel to move the sealing/anchoring element between a radially retracted state a radially expanded state, wherein the internally threaded setting sleeve includes a first setting sleeve portion and a second setting sleeve portion, and further including a dissolvable material positioned between the first setting sleeve portion and the second setting sleeve portion, the dissolvable material configured to remain intact until the sealing/anchoring element is in its fully radially expanded state and thereafter dissolve leaving independent locking first and second setting sleeve portions;

coupling a rotary motor with the internally threaded setting sleeve; and actuating the rotary motor to rotate and axially translate the internally threaded setting sleeve to move the sealing/anchoring element from the radially retracted state to the radially expanded state.

19. A sealing/anchoring assembly, comprising:

a mandrel;

a sealing/anchoring element positioned about the mandrel;

a setting sleeve coupled with a first end of the sealing/anchoring element;

an internally threaded setting sleeve coupled with a second end of the sealing/anchoring element, the internally threaded setting sleeve configured to employ its internal threads to rotate and axially translate along the mandrel to move the sealing/anchoring element between a radially retracted state a radially expanded state, wherein the internally threaded setting sleeve includes a first setting sleeve portion and a second setting sleeve portion, wherein the first setting sleeve portion has one of a male member or female member, and the second setting sleeve portion has an other of the female member or the male member, the male and female members configured to rotationally fix the first setting sleeve portion and the second setting sleeve portion as the sealing/anchoring element is moving from the radially retracted state to the radially expanded state but allow the second setting sleeve portion to be at least partially rotationally free from the first setting sleeve portion once the sealing/anchoring element is in its fully radially expanded state, thereby leaving independent locking first and second setting sleeve portions; and a rotary motor positioned about the mandrel, the rotary motor configured to axially translate along the mandrel without rotating to engage the internally threaded setting sleeve, and then after engaging the internally threaded setting sleeve rotate and axially translate to rotate and axially translate the internally threaded setting sleeve along the mandrel.

20. A sealing/anchoring assembly, comprising:

a mandrel;

a sealing/anchoring element positioned about the mandrel;

a setting sleeve coupled with a first end of the sealing/anchoring element;

an internally threaded setting sleeve coupled with a second end of the sealing/anchoring element, the internally threaded setting sleeve configured to employ its internal threads to rotate and axially translate along the mandrel to move the sealing/anchoring element between a radially retracted state a radially expanded state, wherein the internally threaded setting sleeve includes a first setting sleeve portion and a second setting sleeve portion, wherein the first setting sleeve portion and the second setting sleeve portion include one or more axially aligned passageways therethrough, the one or more axially aligned passageways configured to receive one or more related post members from a rotary motor coupled thereto, such that the first and second setting sleeve portions are rotationally fixed relative to one another when the one or more related post members are within the one or more axially aligned passageways but are independent locking first and second setting sleeve portions free to rotate relative to one another when the one or more related post members are not within the one or more axially aligned passageways; and the rotary motor positioned about the mandrel, the rotary motor configured to axially translate along the mandrel without rotating to engage the internally threaded setting sleeve, and then after engaging the internally threaded setting sleeve rotate and axially translate to rotate and axially translate the internally threaded setting sleeve along the mandrel.

* * * * *